US007506474B2

(12) United States Patent
Yoshikawa et al.

(10) Patent No.: US 7,506,474 B2
(45) Date of Patent: Mar. 24, 2009

(54) CAM MECHANISM FOR SHIFTING A ROTARY MEMBER SUPPORTED ON A BASE MEMBER WHEN THE ROTARY MEMBER IS OPENED AND CLOSED

(75) Inventors: Takashi Yoshikawa, Izumi (JP); Hiroshi Yoshimura, Tondabayashi (JP); Itsuo Fujibayashi, Kishiwada (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 161 days.

(21) Appl. No.: 10/471,612

(22) PCT Filed: Mar. 4, 2002

(86) PCT No.: PCT/JP02/01985

§ 371 (c)(1),
(2), (4) Date: Sep. 12, 2003

(87) PCT Pub. No.: WO02/075229

PCT Pub. Date: Sep. 26, 2002

(65) Prior Publication Data

US 2004/0093799 A1 May 20, 2004

(30) Foreign Application Priority Data

| | | |
|---|---|---|
| Mar. 13, 2001 | (JP) | 2001-070500 |
| Apr. 6, 2001 | (JP) | 2001-108384 |
| Apr. 20, 2001 | (JP) | 2001-122097 |
| Jun. 26, 2001 | (JP) | 2001-193340 |

(51) Int. Cl.
*F25D 23/02* (2006.01)

(52) U.S. Cl. ..... 49/257; 49/258; 49/260; 49/276; 312/324

(58) Field of Classification Search ..... 49/382, 49/318, 192, 193, 236, 238, 240, 245, 255, 49/256, 257, 258, 260, 276; 16/231, 242, 16/246; 312/324, 405
See application file for complete search history.

(56) References Cited

U.S. PATENT DOCUMENTS 4,495,673 A 1/1985 Khan (Continued)

FOREIGN PATENT DOCUMENTS

EP 0 456 008 A1 11/1991

(Continued)

*Primary Examiner*—Gregory J. Strimbu
(74) *Attorney, Agent, or Firm*—Birch, Stewart, Kolasch & Birch, LLP

(57) ABSTRACT

A cam mechanism has different portions thereof arranged on a main unit, which may be a refrigerator, and on a door. When the door is closed, a hinge pin is locked at one end of a hinge groove, keeping the cam mechanism in a first locked position. As the door is opened, the hinge pin is guided by the hinge groove and a guide pin is guided by a guide groove, permitting the door to rotate and slide. Thus, the hinge pin is locked at the other end of the hinge groove, bringing the cam mechanism to a second locked position. A boss slides on a rib and thereby maintains the second locked position, permitting the door to rotate about the hinge pin. This structure helps realize a door opening/closing mechanism with enhanced operability at reduced cost.

17 Claims, 29 Drawing Sheets

U.S. PATENT DOCUMENTS

| | | | | | |
|---|---|---|---|---|---|
| 4,503,582 | A | * | 3/1985 | Gurubatham | 16/232 |
| 4,609,234 | A | | 9/1986 | Naniwa et al. | |
| 5,187,836 | A | * | 2/1993 | Kim et al. | 16/231 |
| 5,406,748 | A | * | 4/1995 | Davlantes | 49/169 |
| 5,548,927 | A | * | 8/1996 | Song | 49/193 |
| 5,675,934 | A | * | 10/1997 | Park | 49/193 |
| 6,000,771 | A | * | 12/1999 | Wissinger et al. | 312/405 |
| 6,085,463 | A | * | 7/2000 | Yoshikawa | 49/193 |
| 6,802,155 | B1 | * | 10/2004 | Kawabata et al. | 49/192 |

FOREIGN PATENT DOCUMENTS

| | | | |
|---|---|---|---|
| JP | 57-073381 | A | 5/1982 |
| JP | 58-148380 | A | 9/1983 |
| JP | 59-45482 | U | 3/1984 |
| JP | 60-24390 | B2 | 6/1985 |
| JP | 2-52082 | U | 4/1990 |
| JP | 7-301484 | A | 11/1995 |
| JP | 2558895 | Y2 | 9/1997 |
| JP | 9-303942 | A | 11/1997 |
| JP | 2002-130924 | A | 5/2002 |
| JP | 2003-4115 | A | 1/2003 |
| KR | 20-1 990-0003354 | Y1 | 4/1990 |
| KR | 100152116 | B1 | 6/1998 |

* cited by examiner

CAM MECHANISM FOR SHIFTING A ROTARY MEMBER SUPPORTED ON A BASE MEMBER WHEN THE ROTARY MEMBER IS OPENED AND CLOSED

This application is the national phase under 35 U.S.C. § 371 of PCT International Application No. PCT/JP02/01985 which has an International filing date of Mar. 4, 2002, which designated the United States of America.

BACKGROUND OF THE INVENTION

1. Field of the Invention

The present invention relates to a cam mechanism provided partly on a base member and partly on a rotating member so as to permit the rotating member to rotate while shifting its pivoted position. The present invention relates also to a door opening/closing mechanism that permits the opening of a storage compartment of a refrigerator or the like to be opened and closed by the rotation of a rotating member.

2. Description of the Related Art

Conventional door opening/closing mechanisms for hinged double doors have a partition board provided in the middle of an opening of a refrigerator so that a left door and a right door close the opening by making contact with the partition board. The partition board hinders work conducted through the opening. For this reason, some door opening/closing mechanisms do away with such a partition board and use gaskets to fill the gap between the left and right doors.

However, when gaskets are provided there, opening one door causes the gasket provided on that door to rub against the gasket provided on the other door. This rubbing together produces a frictional force, which leads to problems such as a great force required when the doors are opened or closed and breakage of the gaskets.

To solve these problems, Japanese Patent Application Laid-Open No. S60-24390 discloses a door opening/closing mechanism in which, when one door starts opening, it slides away from the other door. This door opening/closing mechanism has a first rotary shaft provided on a bracket provided so as to protrude frontward from a chassis forming the outer walls of an opening.

A lever member is mounted on the bracket, and the first rotary shaft is fitted into a hole formed at one end of the lever member. A second rotary shaft is formed integrally at the other end of the lever member, and a door is pivoted on the second rotary shaft. Moreover, a guide member is provided so that, when the door is opened, the lever member rotates about the first rotary shaft, and a spring is provided to load the lever member with a force that tends to move it back to its original position.

When one door is opened, the lever member rotates by being guided by the guide member and, as the lever member rotates, the door slides over a predetermined distance. This causes the door to move away from the other door. Thereafter, the door moves away from the opening, and the guide member disengages from the lever member, letting the lever member move back to its original position under the force exerted by the spring. Then, the door opens by rotating about the second rotary shaft.

When the door is closed, it approaches the opening by rotating about the second rotary shaft. Thereafter, the guide member starts engaging with the lever member against the force exerted by the spring, letting the lever member rotate about the first rotary shaft, so that the door slides away from the other door. Then, as the door is closed, the lever member, by being guided by the guide member, moves back to its original position under the force exerted by the spring. In this way, the door is closed.

However, in the door opening/closing mechanism disclosed in Japanese Patent Application Laid-Open No. S60-24390 mentioned above, a frictional force commensurate with the weight of the door acts on the surfaces on which the lever member and the bracket slide relative to each other. This requires that the spring be designed to exert a force greater than the frictional force.

As a result, to open the door, a great force is required against the frictional force of the lever member and the force exerted by the spring, leading to poor operability. Moreover, the provision of the lever member and the spring increases the number of parts needed and the number of assembly steps, leading to high cost and low reliability of the door opening/closing mechanism.

SUMMARY OF THE INVENTION

An object of the present invention is to provide a door opening/closing mechanism that not only helps enhance operability but also helps reduce costs and enhance reliability. Another object of the present invention is to provide a cam mechanism that, with a simple structure, permits a rotary member to shift its pivoted position. Still another object of the present invention is to provide a door opening/closing mechanism that, with a simple structure, permits a door to shift its pivoted position between in a state where the door is closed and in a state where the door is open.

To achieve the above objects, according to one aspect of the present invention, a cam mechanism is provided with: a cam member having first and second cam surfaces and provided on one of a base member and a rotary member; an arc-shaped rib contact-engaging with the first and second cam surfaces of the cam member and provided on the other of the base member and the rotary member; and a pivot shaft concentric with the rib and loosely fitted into, so as to be movable relative thereto, an elongate-hole-shaped shaft socket formed in one of the rib and the cam member. Here, as the cam surface that contact-engages with the rib moves along the first cam surface to the second cam surface, the position in which the rotary member is pivoted is slid so that the rib and the second cam surface slide-engage with each other and thereby restrict the position in which the rotary member is pivoted.

According to another aspect of the present invention, in a cam mechanism, on one of a base member and a rotary member are provided a pivot shaft on which the rotary member is pivoted and a cam member having first and second cam surfaces, on the other of the base member and the rotary member are provided an elongate-hole-shaped shaft socket into which the pivot shaft is loosely fitted and a rib that contact-engages with the first and second cam surfaces, and, as the cam surface that contact-engages with the rib moves along the first cam surface to the second cam surface, the position in which the rotary member is pivoted is slid so that the rib and the second cam surface slide-engage with each other and thereby restrict the position in which the rotary member is pivoted.

According to another aspect of the present invention, a door opening/closing mechanism for pivotably supporting a door in front of an opening formed in a main unit of an appliance in such a way that the door can be opened and closed freely is provided with: a cam mechanism having a cam member in which an elongate-hole-shaped hinge groove is formed for supporting a hinge pin, which serves as a pivot shaft on which the door is pivoted, in such a way that the hinge pin is slidable relative to the hinge groove. Here, the cam mechanism permits the hinge pin to shift relatively between a position corresponding to the state in which the door is closed and a position corresponding to the state in which the door is pivoted and open.

According to another aspect of the present invention, a door opening/closing mechanism for pivotably supporting a door in front of an opening formed in a main unit of an appliance in such a way that the door can be opened and closed freely is provided with: a cam mechanism having a hinge groove for supporting a hinge pin, which serves as a pivot shaft on which the door is pivoted, in such a way that the hinge pin is slidable relative to the hinge groove. Here, the cam mechanism permits the door, when the door starts being opened, to slide, while rotating, from the non-pivoted side to the pivoted side.

According to another aspect of the present invention, a door opening/closing mechanism for pivotably supporting a plurality of doors in front of an opening formed in a main unit of an appliance in such a way that the doors can be opened and closed freely in opposite directions is provided with: a cam mechanism having hinge grooves for supporting hinge pins, which serve as pivot shafts on which the doors are pivoted, in such a way that the hinge pins are slidable relative to the hinge grooves. Here, the cam mechanism permits the doors, when the doors start being opened, to slide, while rotating, away from the opposite doors.

According to another aspect of the present invention, in a door opening/closing mechanism for opening and closing doors arranged so as to cover an opening formed in a main unit of an appliance, with the boundary between the two doors lying substantially in the middle of the opening and with the doors pivoted at opposite sides of the opening, a cam mechanism is provided that is in a first locked position when the doors are closed and that, as the doors are opened, slides the doors from the open side to the pivoted side and thereby shifts to a second locked position, in which the cam mechanism pivotably supports the doors. Here, the cam mechanism has different portions thereof arranged separately at the pivoted and open sides of the doors.

According to another aspect of the present invention, in a door opening/closing mechanism including a cam mechanism that guides a door covering an opening formed in a main unit of an appliance in such a way as to rotate the door and thereby open and close the door and that has different portions thereof arranged separately on the door and on the main unit of the appliance, the cam mechanism is, when the door is closed, in a first locked position and, as the door is opened, shifts to a second locked position with the door moving along the rotation axis thereof and simultaneously sliding perpendicularly to the rotation axis thereof, and the cam mechanism, when in the second locked position, pivotably supports the door and thereby permits the door to be opened.

BRIEF DESCRIPTION OF THE DRAWINGS

FIG. 36C is a sectional view taken through pin 23 on the opened side of the door of FIG. 37A.

FIG. 36C is a sectional view taken through pin 23 on the opened side of the door of FIG. 38A.

DETAILED DESCRIPTION OF THE INVENTION

Figure 1:
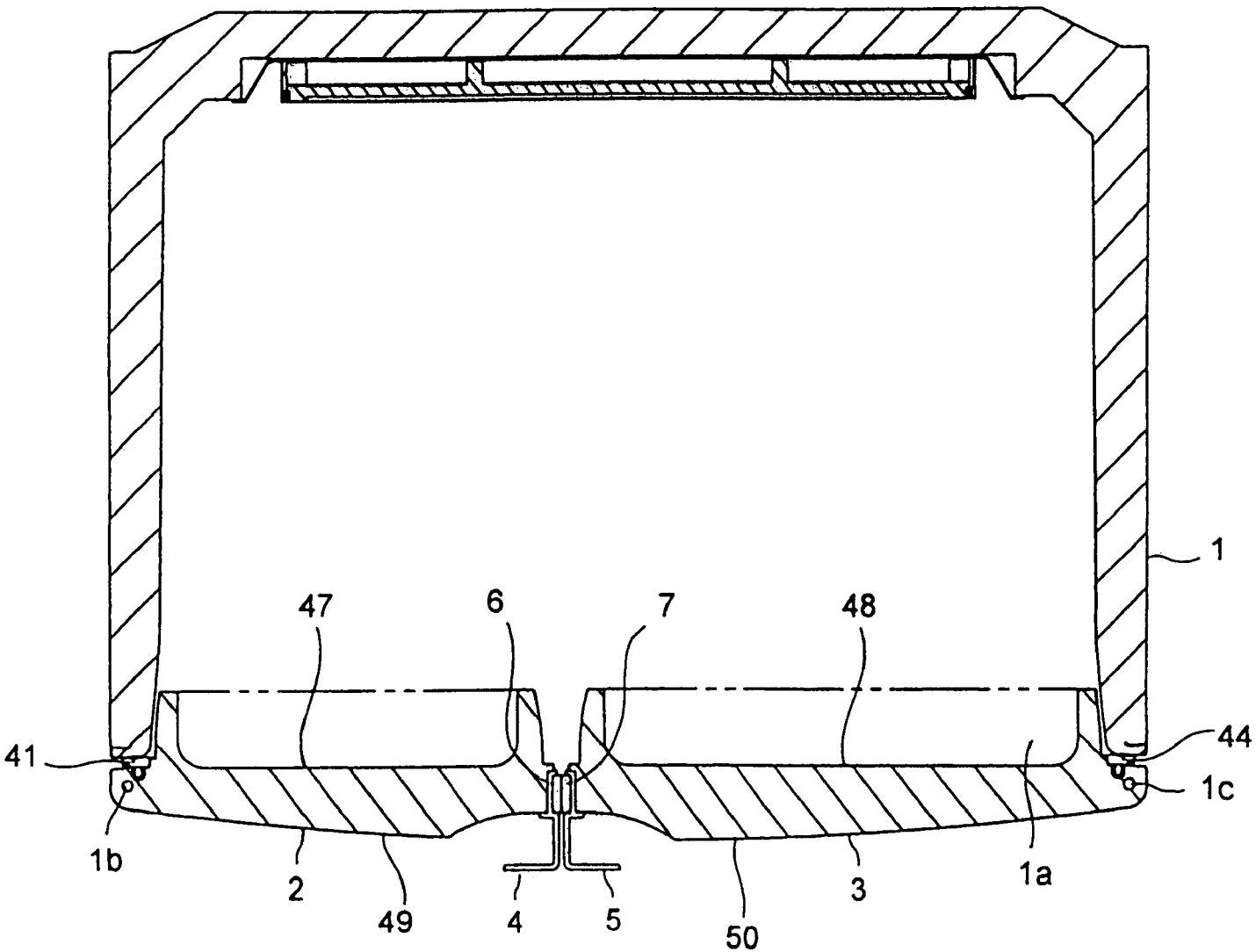
FIG. 1 is a sectional view as viewed from above showing the door opening/closing mechanism of a first embodiment of the invention.

Hereinafter, embodiments of the present invention will be described with reference to the drawings. FIG. 1 is a sectional view as viewed from above showing the door opening/closing mechanism of a first embodiment. In the main unit of a refrigerator or the like, an opening 1*a* is formed whose outer walls are formed by a chassis 1. The opening 1*a* is divided, by a boundary line running near the middle thereof, into a left portion covered by a left door 2 and a right portion covered by a right door 3. The left door 2 and the right door 3 are provided with handles 4 and 5, respectively, at one end.

The left and right doors 2 and 3 are, at the other end, pivoted on rotary shafts 1*b* and 1*c*, respectively, that slide relative to the left and right doors 2 and 3 by the action of cam mechanisms as will be described later. Holding the handles 4 and 5, the user can open the left and right doors 2 and 3 in opposite directions. The gap between the left and right doors 2 and 3 is filled by gaskets 6 and 7 fitted respectively thereto. The gaskets 6 and 7 have magnets (not shown) embedded therein so that they attract each other and thereby hermetically close the gap.

The left and right doors 2 and 3 are respectively composed of door plates 49 and 50, which cover the front face thereof, and door backs 47 and 48, which are provided at the back thereof, coupled together with door caps 55 and 56 (see FIG. 3), which are arranged at the top and bottom thereof, and side plates (not shown), which are arranged at the sides thereof, in such a way that the doors 2 and 3 are closed around their rims. A urethane blowing agent is injected into the doors 2 and 3 and is then heated so that they are filled with urethane resin foam. This achieves thermal insulation of the interior of the main unit.

Figure 2:
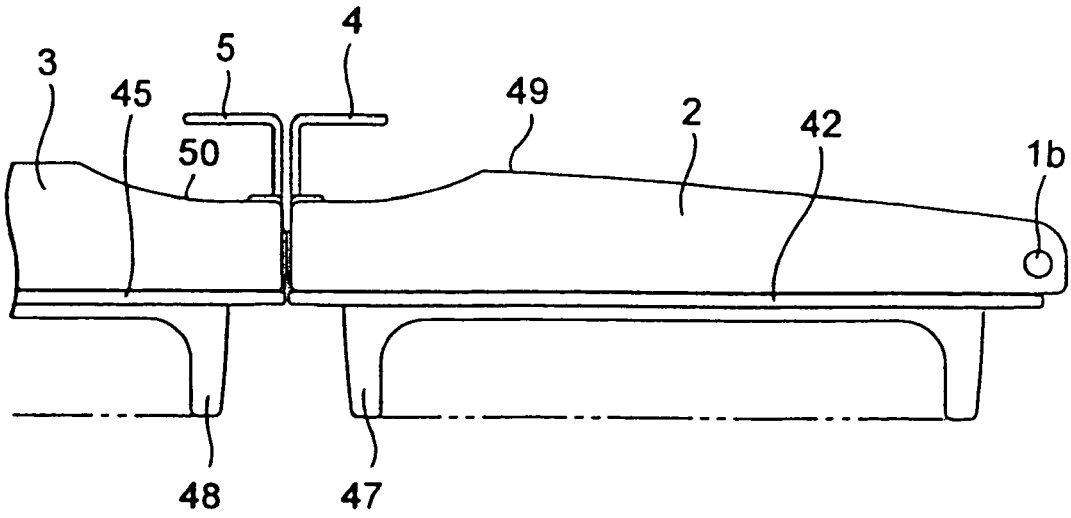
FIG. 2 is a top view showing a principal portion of the door opening/closing mechanism of the first embodiment of the invention.
Figure 3:
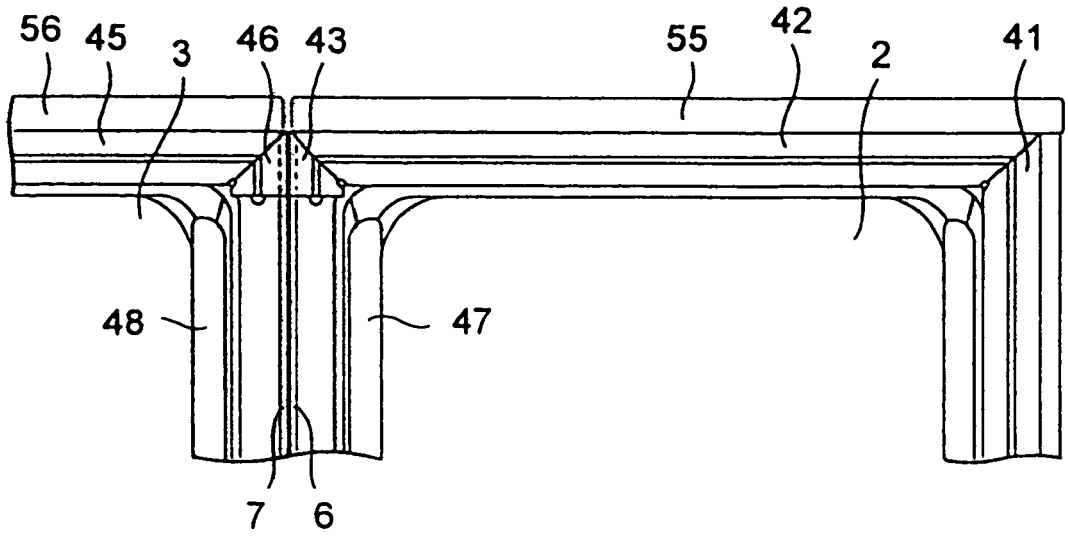
FIG. 3 is a rear view showing a principal portion of the door opening/closing mechanism of the first embodiment of the invention.

FIGS. 2 and 3 are a top view and a rear view showing a principal portion of the left and right doors 2 and 3. Gaskets 41, 42, and 43 are fitted to the door back 47 along one side edge, the top edge, and the opposite side edge thereof, respectively. The gaskets 41, 42, and 43 are cut obliquely at both ends, and are fused together under heat so as to form a single piece. Although not shown, gaskets are fitted to the door back 47 also in the lower portion thereof, just like the gaskets 41, 42, and 43 arranged upside down.

Likewise, gaskets 44, 45, and 46 (for 44, see FIG. 1) and a lower gasket (not shown) are fitted to the door back 48 around the edges thereof so as to form a single piece. When the left and right doors 2 and 3 are closed, the door backs 47 and 48 fit into the opening 1*a* (see FIG. 1), and the gaskets 41 to 46 make contact with the chassis 1 (see FIG. 1). The gaskets 41 to 46 have flexible magnets (not shown) embedded therein, and thus attract the chassis 1 of the main unit and thereby keep the left and right doors 2 and 3 hermetically on the chassis 1.

Figure 4A:
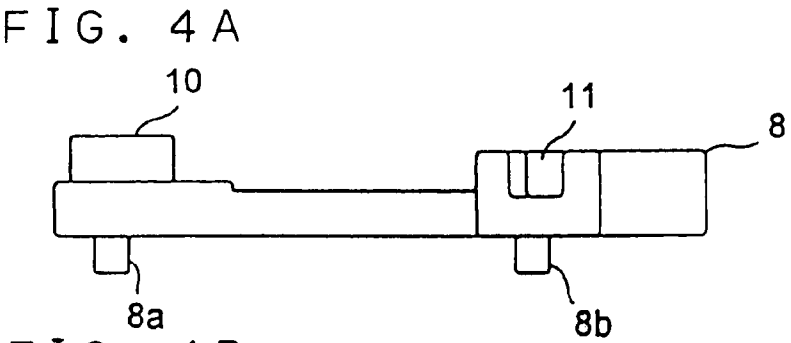
FIG. 4A is a rear view of the lower left slide cam member of the door opening/closing mechanism of the first embodiment of the invention.
Figure 4B:
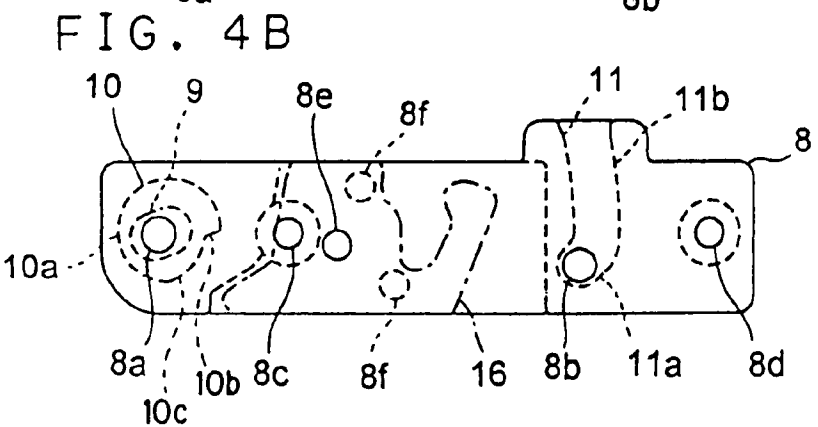
FIG. 4B is a plan view of the lower left slide cam member of FIG. 4A.
Figure 4C:
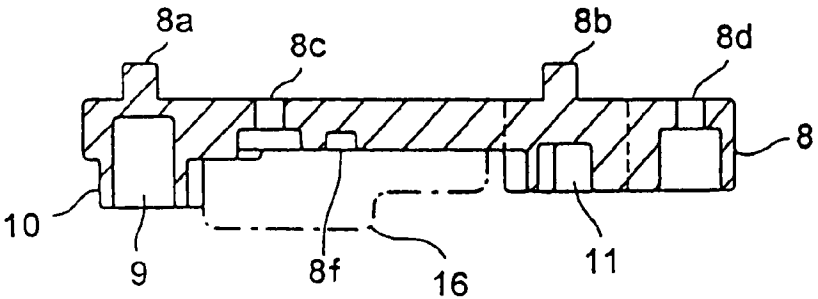
FIG. 4C is a sectional view as viewed from the front of the slide cam member of FIG. 4A.
Figure 4D:
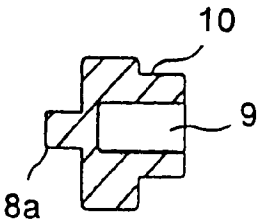
FIG. 4D is a sectional view in the direction of the right side of the slide cam member of FIG. 4A.
Figure 4E:
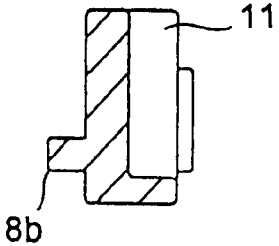
FIG. 4E is a sectional view along a guide groove as viewed from the right side of the slide cam member of FIG. 4A.

As cam mechanisms, similar structures are provided in four places, namely at the top of the left door 2, at the bottom of the left door 2, at the top of the right door 3, and at the bottom of the right door 3. FIGS. 4A to 4E are diagrams showing the slide cam member arranged at the bottom of the left door 2. Of these diagrams, FIG. 4A is a rear view, FIG. 4B is a plan view, FIG. 4C is a sectional view as viewed from the front, FIG. 4D is a sectional view along the hinge groove 9 as viewed from the right side, and FIG. 4E is a sectional view along the guide groove 11 as viewed from the right side.

The slide cam member 8, which is a resin molding, has bosses 8*a* and 8*b* formed on the top surface thereof, and has screw holes 8*c* and 8*d* formed therethrough. The slide cam member 8 is fitted on the bottom surface of the left door 2 with the bosses 8*a* and 8*b* fitted into boss holes (not shown) formed in the bottom surface of the left door 2 and with self-tapping screws (not shown) screwed through the screw holes 8*c* and 8*d*. The slide cam member 8 also has a boss hole 8*f* and a screw hole 8*e* formed therein to permit a lock member 16, described later, to be fitted thereto.

At one end of the bottom surface of the slide cam member 8, a hinge groove 9 having the shape of an elongate hole is formed. Around the hinge groove 9, a boss (cam member) 10 is formed. The boss 10 has a first, a second, and a third cam surface formed thereon. The second cam surface 10*a* is a cylindrical surface about a hinge pin 23 (see FIG. 16) as it is located in the second locked position corresponding to the open-door state described later.

The first cam surface 10*b* keeps contact (cam-engages) with a rib 19 (see FIG. 14) from the first locked position corresponding to the closed-door state to the second locked position corresponding to the open-door state. Thus, the boss 10 is guided leftward in the figure (toward where the door is pivoted). The third cam surface 10*c* makes contact with the rib 19 in the first locked position.

On the side of the hinge groove 9 closer to the middle of the opening 1*a* (see FIG. 1), a guide groove 11 (see FIG. 2) bent into the shape of an inverted L is formed. The guide groove 11 has a guide portion 11*a* and a clearance portion 11*b*. The guide portion 11*a* guides a guide pin 25 (see FIGS. 13 to 16) relatively in such a way as to move it from the first locked position corresponding to the closed-door state to the second locked position corresponding to the open-door state. The clearance portion 11*b* permits the guide pin 25 to be released therefrom relatively when the door is opened in the second locked position.

Figure 5D:
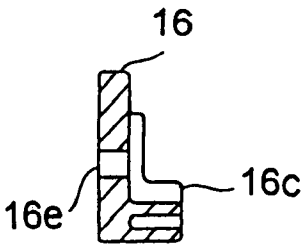
FIG. 5D is a sectional view along the screw hole of FIG. 5A as viewed from the right side.
Figure 5B:
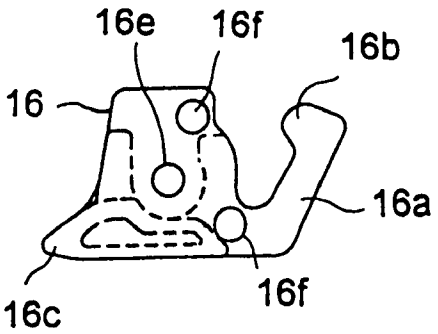
FIG. 5B is a plan view of the lock member of FIG. 5A.
Figure 5C:
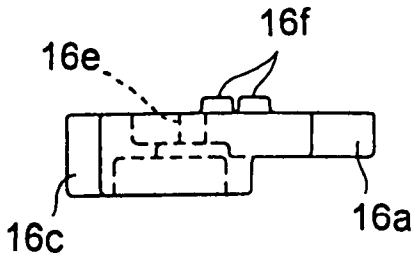
FIG. 5C is a front view of the lock member of FIG. 5A.
Figure 5A:
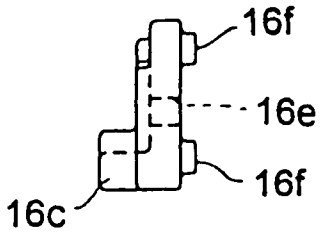
FIG. 5A is a left side view of the lower left lock member of the door opening/closing mechanism of the first embodiment of the invention.

FIGS. 5A to 5D are diagrams showing the lock member fitted to the slide cam member 8. FIG. 5A is a left side view, FIG. 5B is a plan view, FIG. 5C is a front view, and FIG. 5D is a sectional view along the screw hole 16*e* as viewed from the right side. The lock member 16, which is a resin molding, has a boss 16*f* formed on the top surface thereof, and has a screw hole 16*e* formed therethrough.

The lock member 16 is fitted to the slide cam member 8 with the boss 16*f* fitted into the boss hole 8*f* formed in the bottom surface of the slide cam member 8 and with a self-tapping screw (not shown) screw-engaged with the screw hole 8*e* of the slide cam member 8 (in FIGS. 4B and 4C, dash-and-dot lines indicate the lock member 16 in its fitted state).

At one end of the lock member 16, an arm portion 16*a* is formed so as to extend therefrom. The arm portion 16*a* elastically deforms under a load that acts on it substantially perpendicularly to the direction in which it extends. At the end of the arm portion 16*a*, an engagement portion 16*b* is formed that engages with a lock pin 24 (see FIG. 13), described later. At the other end of the lock member 16, a restricting portion 16*c* is formed that makes contact with a stopper 18*e* (see FIG. 8A), described later, and thereby restricts the rotation of the left door 2.

Figure 6:
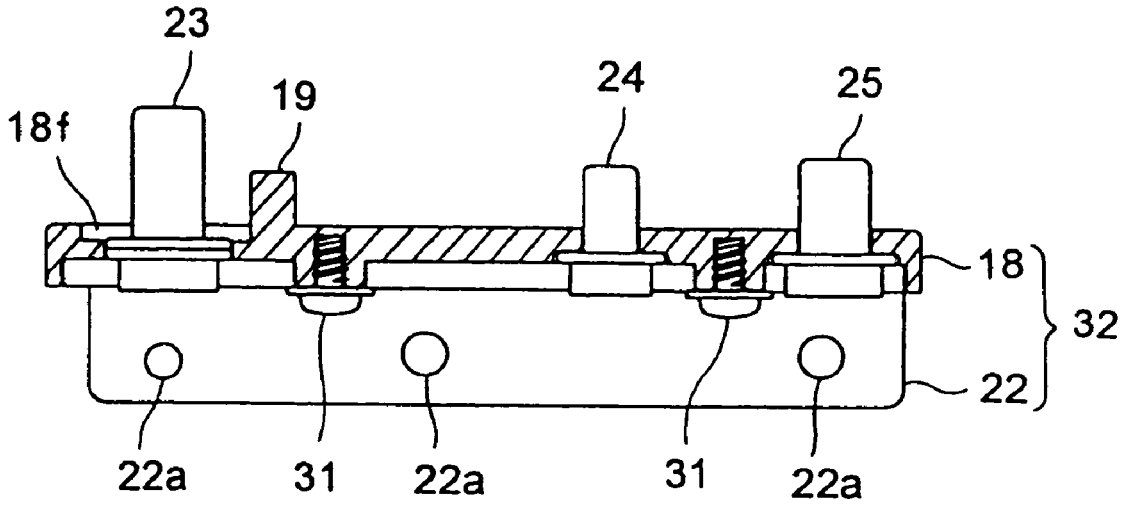
FIG. 6 is a diagram showing the lower left lock cam assembly of the door opening/closing mechanism of the first embodiment of the invention.

FIG. 6 is a sectional view as viewed from the front showing the lock cam assembly that is fitted, with screws, at the lower left of the opening 1*a* (see FIG. 1) of the chassis 1. The lock cam assembly 32 is composed of a lock cam member 18 and an angle 22 fitted together with screws 31 so as to form a single unit, and, by engaging with the slide cam member 8, forms the cam mechanism. The lock cam member 18 is a resin molding, and the angle 22, which needs to bear the weight of the left door 2, is a metal member.

Figure 7C:
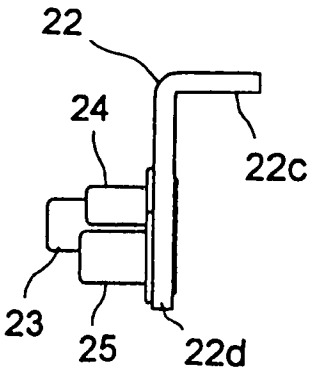
FIG. 7C is a side view of the lock cam member of FIG. 7A.
Figure 7A:
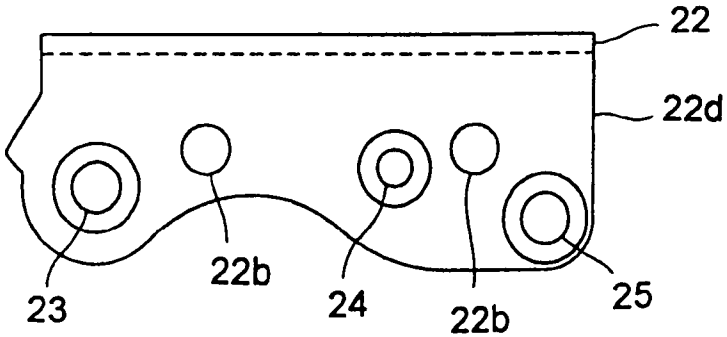
FIG. 7A is a plan view of the lower left lock cam member of the door opening/closing mechanism of the first embodiment of the invention.
Figure 7B:
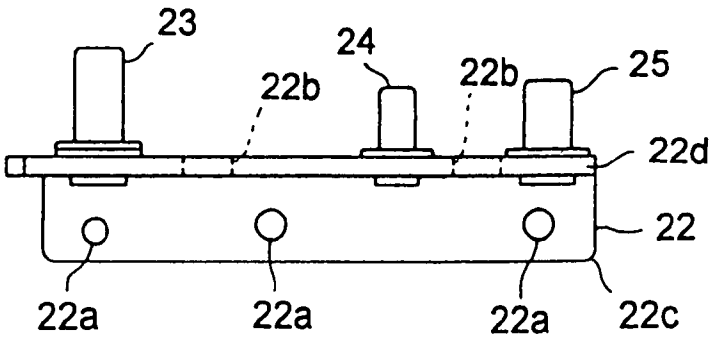
FIG. 7B is a front view of the lock cam member of FIG. 7A.

FIGS. 7A to 7C are diagrams showing the angle 22. FIG. 7A is a plan view, FIG. 7B is a front view, and FIG. 7C is a side view. The angle 22 has screw holes 22*a* formed in three places in the upright portion 22*c* thereof. With self-tapping screws (not shown) screwed through the screw holes 22*a*, the angle 22, and thus the lock cam assembly 32, is fitted to the chassis 1 (see FIG. 1).

The angle 22 has boss holes 22*b* formed in the horizontal portion 22*d* thereof. Moreover, a hinge pin 23, a lock pin 24, and a guide pin 25, each formed out of, for example, metal such as stainless steel, are swaged onto the angle 22 to form a single unit.

Figure 8A:
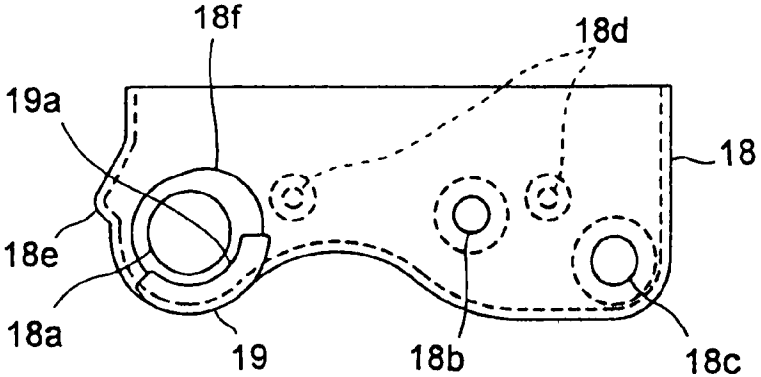
FIG. 8A is a plan view of the lower left angle of the door opening/closing mechanism of the first embodiment of the invention.
Figure 8B:
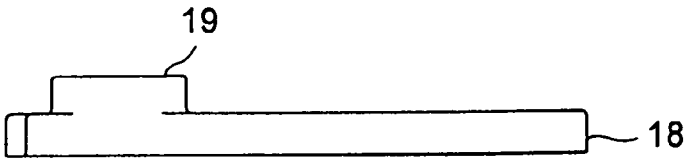
FIG. 8B is a front view of the angle of FIG. 8A.
Figure 8C:
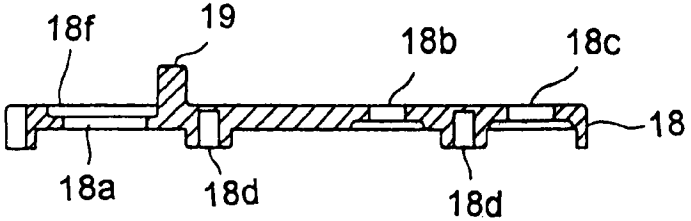
FIG. 8C is a sectional view from the front of the angle of FIG. 8A.
Figure 8D:
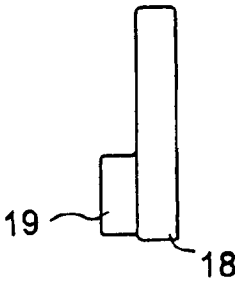
FIG. 8D is a side view of the angle of FIG. 8A.
Figure 8E:
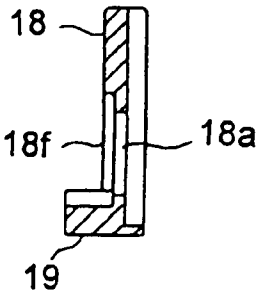
FIG. 8E is a sectional view along a through hole of FIG. 8A as viewed from the side.

FIGS. 8A to 8E are diagrams showing the lock cam member 18. FIG. 8A is a plan view, FIG. 8B is a front view, FIG. 8C is a sectional view as viewed from the front, FIG. 8D is a side view, and FIG. 8E is a sectional view along the through hole 18*a* as viewed from the side. The lock cam member 18 has through holes 18*a*, 18*b*, and 18*c* formed therethrough through which are placed the hinge pin 23, lock pin 24, and guide pin 25 (for all these, see FIGS. 7A to 7C), respectively.

On the bottom surface of the lock cam member 18, bosses 18*d* having a screw hole are formed. The lock cam assembly 32 is assembled as shown in FIG. 6 described earlier with the hinge pin 23, lock pin 24, and guide pin 25 placed through the through holes 18*a*, 18*b*, and 18*c* and with the bosses 18*d* fitted into the boss holes 22*b* (see FIG. 7A) of the angle 22.

Around the through hole 18*a* through which the hinge pin 23 is placed, a rib 19 is formed that has a cylindrical concave surface 19*a* concentric with the hinge pin 23. On the top surface side of the through hole 18*a*, a clearance 18*f* is formed to avoid the sliding friction with the end surface of the boss 10 (see FIG. 8C) of the slide cam member 8. Moreover, at the end of the lock cam member 18, a stopper 18*e* is formed with which the restricting portion 16*c* (see FIG. 5B) of the lock member 16 described earlier makes contact.

Figure 9A:
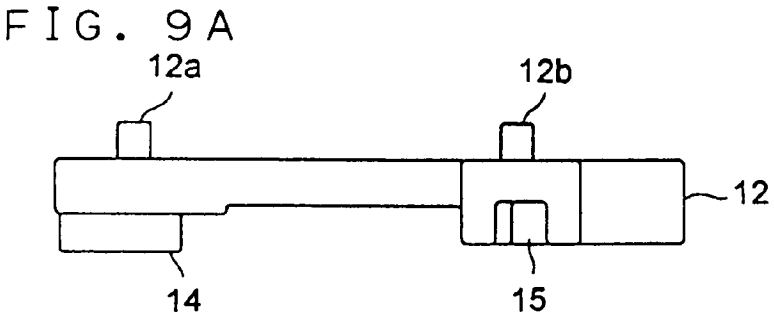
FIG. 9A is a rear view of the slide cam member arranged at the top of the left door 2.
Figure 9D:
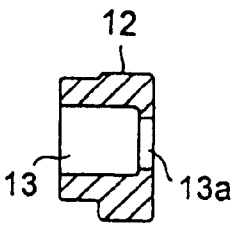
FIG. 9D is a sectional view along the hinge groove of FIG. 9A as viewed from the side.
Figure 9E:
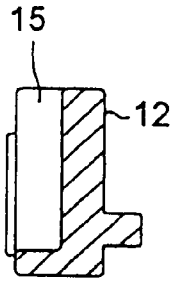
FIG. 9E is a sectional view along the guide groove of FIG. 9A as viewed from the side.
Figure 9B:
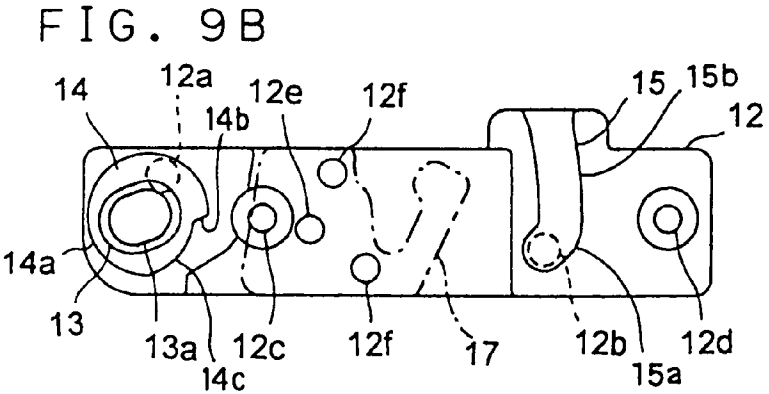
FIG. 9B is a plan view of the slide cam member of FIG. 9A.
Figure 9C:
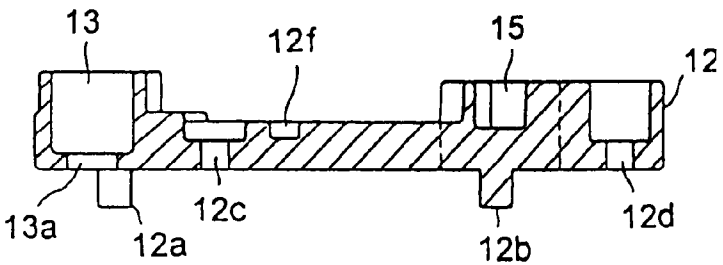
FIG. 9C is a sectional view as viewed from the front of the slide cam member of FIG. 9A.

FIGS. 9A to 9E are diagrams showing the slide cam member arranged at the top of the left door 2. FIG. 9A is a rear view, FIG. 9B is a plan view, FIG. 9C is a sectional view as viewed from the front, FIG. 9D is a sectional view along the hinge groove 13 as viewed from the side, and FIG. 9E is a sectional view along the guide groove 15 as viewed from the side.

The slide cam member 12 is a resin molding, and has a structure similar to the slide cam member 8 shown in FIGS. 4A to 4E described earlier. The slide cam member 12 has bosses 12*a* and 12*b* formed on the bottom surface thereof, and has screw holes 12*c* and 12*d* formed therethrough.

The slide cam member 12 is fitted on the top surface of the left door 2 with the bosses 12*a* and 12*b* fitted into boss holes (not shown) formed in the top surface of the left door 2 and with self-tapping screws (not shown) screwed through the screw holes 12*c* and 12*d*. The slide cam member 12 also has a boss hole 12*f* and a screw hole 12*e* formed therein to permit a lock member 17, described later, to be fitted thereto.

At one end of the top surface of the slide cam member 12, a hinge groove 13 having the shape of an elongate hole is formed. The hinge groove 13 is larger in width than the hinge groove 9 (see FIG. 4B) of the slide cam member 8 provided at the bottom of the left door 2, and has a through hole 13*a* formed at the bottom.

Around the hinge groove 13, a boss 14 is formed that has a first, a second, and a third cam surface 14*b*, 14*a*, and 14*c* formed thereon. The second cam surface 14*a* is a cylindrical surface about a hinge pin 28 (see FIG. 11B) as it is located in the second locked position corresponding to the open-door state described earlier.

The first cam surface 14*b* keeps contact (cam-engages) with a rib 21 (see FIG. 12A) from the first locked position corresponding to the closed-door state to the second locked position corresponding to the open-door state. Thus, the boss 14 is guided leftward in the figure (toward where the door is pivoted). The third cam surface 14*c* makes contact with the rib 21 in the first locked position.

As will be described later, the hinge pin 28 (see FIG. 11B) that engages with the hinge groove 13 is larger in diameter than the hinge pin 23 that engages with the hinge groove 9. Through the hinge pin 28 and through the through hole 13*a*, which has the shape of an elongate hole, electric leads (not shown) are laid. The electric leads are connected to electric component arranged in the left door 2.

The elongate through hole 13*a*, with which the hinge groove 13 guides the hinge pin 28 relatively, has a width (in the direction in which it is longest) greater than the sum of the distance between the first and second locked positions described later and the diameters of the electric leads. This prevents the electric leads from being sheared, when the left door 2 slides, by being pinched between the wall surfaces of the through hole 13*a* and of a through hole 28*a* formed through the hinge pin 28. Moreover, it also prevents the electric leads from being broken by being pressed by the wall surface of the through hole 13*a*.

On the side of the hinge groove 13 closer to the middle of the opening 1*a* (see FIG. 1), a guide groove 15 bent into the shape of an inverted L is formed. The guide groove 15 has a guide portion 15*a* and a clearance portion 15*b*. The guide portion 15*a* guides a guide pin 30 (see FIG. 11B) relatively in such a way as to move it from the first locked position corresponding to the closed-door state to the second locked position corresponding to the open-door state. The clearance portion 15*b* permits the guide pin 30 to be released therefrom relatively when the door is opened in the second locked position.

Figure 10A:
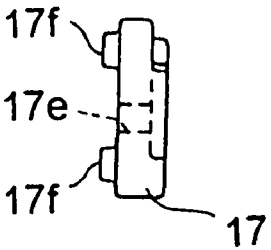
FIG. 10A is a side view of the lower left lock member of the door opening/closing mechanism of the first embodiment of the invention.
Figure 10B:
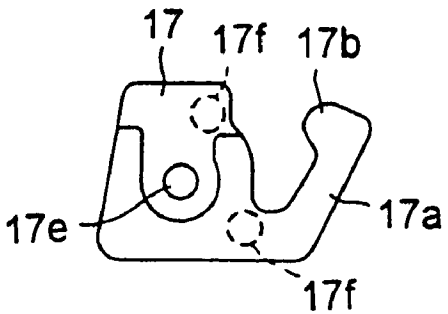
FIG. 10B is a plan view of the lock member of FIG. 10A.
Figure 10C:
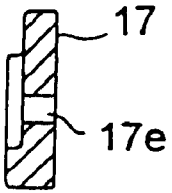
FIG. 10C is a sectional view along the screw hole of FIG. 10A as viewed from the side.
Figure 10D:
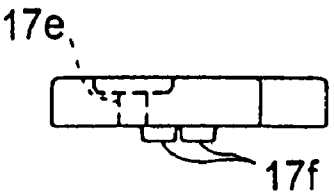
FIG. 10D is a front view of the lock member of FIG. 10A.

FIGS. 10A to 10D are diagrams showing the lock member fitted to the slide cam member 12. FIG. 10A is a side view, FIG. 10B is a plan view, FIG. 10C is a sectional view along the screw hole 17*e* as viewed from the side, and FIG. 10D is a front view. The lock member 17, which is a resin molding, has a boss 17*f* formed on the bottom surface thereof, and has a screw hole 17*e* formed therethrough.

The lock member 17 is fitted to the slide cam member 12 with the boss 17*f* fitted into the boss hole 12*f* formed in the top surface of the slide cam member 12 and with a self-tapping screw (not shown) screw-engaged, through the screw hole 17*e*, with the screw hole 12*e* of the slide cam member 12 (in FIG. 9B, dash-and-dot lines indicate the lock member 17 in its fitted state).

At one end of the lock member 17, an arm portion 17*a* is formed so as to extend therefrom. The arm portion 17*a* elastically deforms under a load that acts on it substantially perpendicularly to the direction in which it extends. At the end of the arm portion 17*a*, an engagement portion 17*b* is formed that engages with a lock pin 29 (see FIG. 11B), described later.

Figure 11C:
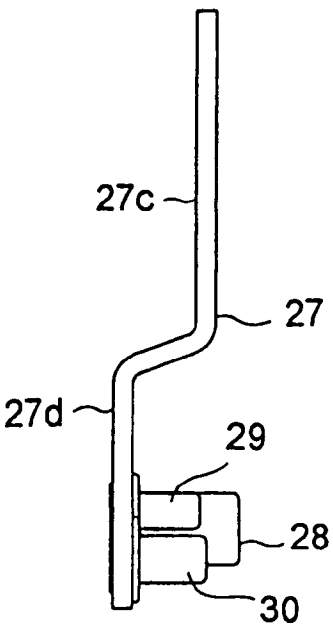
FIG. 11C is a side view of the lock cam member of FIG. 11A.
Figure 11A:
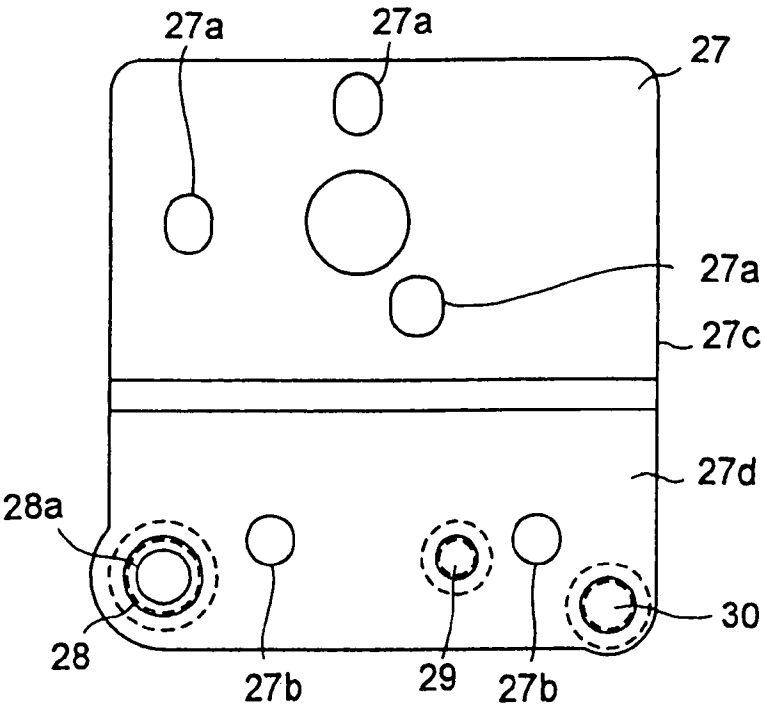
FIG. 11A is a plan view of the lower left lock cam member of the door opening/closing mechanism of the first embodiment of the present invention.
Figure 11B:
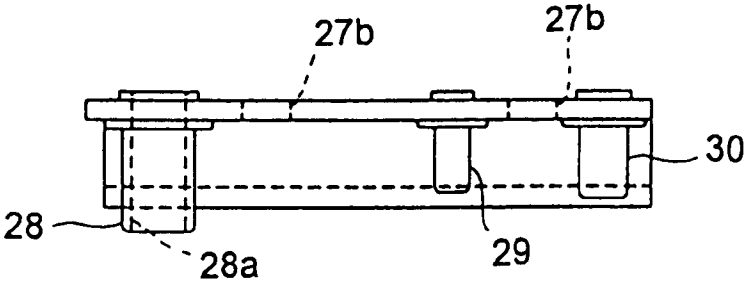
FIG. 11B is a front view of the lock cam member of FIG. 11A.

FIGS. 11A to 11C are diagrams showing the angle of the lock cam assembly fitted at the upper left of the opening 1*a* (see FIG. 1) of the chassis 1. FIG. 11A is a plan view, FIG. 11B is a front view, and FIG. 11C is a side view. The angle 27 is a metal member, and has screw holes 27*a* formed in three places in the fitting portion 27*c* thereof. With self-tapping screws screwed through the screw holes 27*a*, the angle 27, and thus the lock cam assembly 33 (see FIG. 12C), is fitted to the chassis 1.

The angle 27 has boss holes 27*b* formed in the horizontal portion 27*d* thereof. Moreover, a hinge pin 28, a lock pin 29, and a guide pin 30, each formed out of, for example, metal such as stainless steel, are swaged onto the angle 27 to form a single unit. The hinge pin 28 has a through hole 28*a* formed therethrough through which electric leads (not shown) are laid.

Figure 12A:
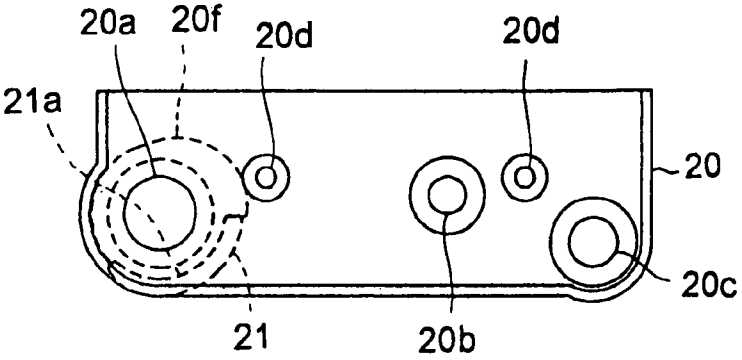
FIG. 12A is a plan view of the lower left angle of the door opening/closing mechanism of the first embodiment of the invention.
Figure 12B:
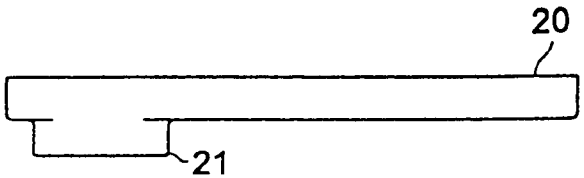
FIG. 12B is a front view of the angle of FIG. 12A.
Figure 12C:
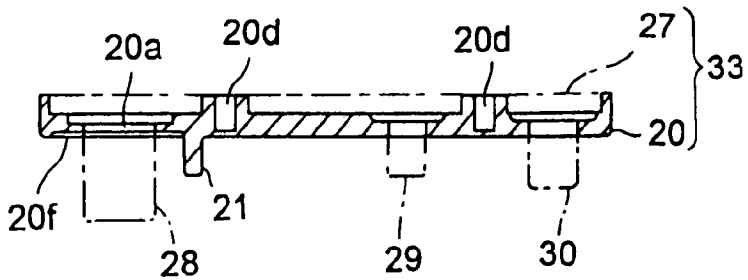
FIG. 12C is a sectional view of the angle of FIG. 12A as viewed from the front.
Figure 12D:
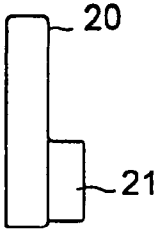
FIG. 12D is a side view of the angle of FIG. 12A.
Figure 12E:
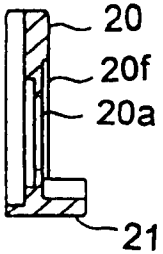
FIG. 12E is a sectional view along the through hole of FIG. 12A as viewed from the side.

FIGS. 12A to 12B are diagrams showing the lock cam member 20 that is assembled with the angle 27 into a single unit. FIG. 12A is a plan view, FIG. 12B is a front view, FIG. 12C is a sectional view as viewed from the front, FIG. 12D is a side view, and FIG. 12E is a sectional view along the through hole 20*a* as viewed from the side. The lock cam member 20 has through holes 20*a*, 20*b*, and 20*c* formed therethrough through which are placed the hinge pin 28, lock pin 29, and guide pin 30, respectively.

On the top surface of the lock cam member 20, bosses 20*d* having a screw hole are formed. The lock cam assembly 33 is assembled as shown in FIG. 12C with the hinge pin 28, lock pin 29, and guide pin 30 placed through the through holes 20*a*, 20*b*, and 20*c* and with the bosses 20*d* fitted into the boss holes 27*b* (see FIG. 11A) and tightened with screws.

The lock cam assembly 33, by engaging with the slide cam member 12 (see FIGS. 9A to 9E), forms the cam mechanism. In cases where the door is a light-weight lid or the like, the lock cam assemblies 32 and 33 may be formed integrally with the door by resin molding.

Around the through hole 20*a* through which the hinge pin 28 is placed, a rib 21 is formed that has a cylindrical concave surface 21*a* concentric with the hinge pin 28. On the bottom surface side of the through hole 20*a*, a clearance 20*f* is formed to avoid the sliding friction with the boss 14 (see FIG. 9B) of the slide cam member 12.

The upper cam mechanism composed of the slide cam member 12 and the lock cam assembly 33 operates in the same manner as the lower cam mechanism composed of the slide cam member 8 and the lock cam assembly 32. At the top and bottom of the right door 3 are provided cam mechanisms that have structures symmetric with the cam mechanisms provided on the left door 2.

Next, the operation of the cam mechanism will be described with reference to FIGS. 13 to 16. These figures show the cam mechanism provided at the bottom of the left door 2, and the cam mechanisms provided in the other places operate in similar manners. In these figures, all the parts of the cam mechanism, which customarily should be indicated with broken lines, are indicated with solid lines for convenience's sake. On the other hand, hatching indicates parts of members provided on the part of the chassis 1.

Figure 13:
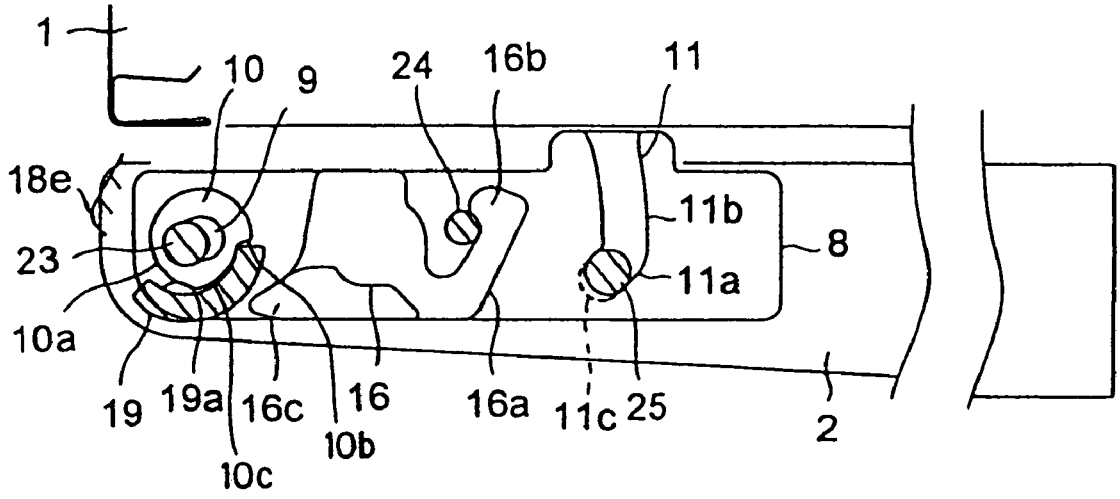
FIG. 13 is a plan view of the door opening/closing mechanism of the first embodiment of the invention, in the state in which the door is closed.

FIG. 13 shows the state in which the left door 2 is closed. With the left door 2 closed, the hinge pin 23 is locked at one end of the hinge groove 9, and the cam mechanism is in the first locked position. In the first locked position, the guide pin 25 is located at the end of the guide portion 11*a* of the guide groove 11.

The lock pin 24 engages with the engagement portion 16*b* of the lock member 16, and the elastic force of the arm portion 16*a* loads the left door 2 with a force that tends to move it toward the right door 3 (see FIG. 1) (rightward in the figure). This permits a predetermined gap to be maintained between the left and right doors 2 and 3, and simultaneously prevents play of the left door 2 (leftward in the figure) ascribable to the gap between the hinge pin 23 and the hinge groove 9.

In this way, the cam mechanism maintains the first locked position, keeping the left door 2 hermetically closed more securely than ever. Simultaneously, the third cam surface 10*c* of the boss 10 keeps contact with the rib 19, and this permits the cam mechanism to be positioned in the first locked position. Therefore, in the first locked position, a gap may be left between the hinge pin 23 and one end of the hinge groove 9.

As shown in FIG. 1 described earlier, the gap between the left and right doors 2 and 3 is filled by the gaskets 6 and 7 fitted respectively thereto. In a case where the gap is hermetically closed by the elastic deformation of the gaskets 6 and 7, the pivoted position is restricted as a result of the force exerted by the lock member 16 balancing with the elastic force of the gaskets fitted on the rear and side surfaces of the left door 2. Therefore, to prevent the pivoted position from being determined as a result of the hinge pin 23 being locked at one end of the hinge groove 9, it is advisable to form the hinge groove 9 in such a way that a gap is left between one end of the hinge groove 9 and the hinge pin 23 when the door is closed.

Moreover, it is advisable to form the end of the guide portion 11*a* in such a way as to leave a gap also between it and the guide pin 25 as indicated by a broken line 11*c*. Leaving a gap here prevents the cam mechanism from being restricted before reaching the first locked position as a result of the guide pin 25 making contact with the guide groove 11.

Figure 14:
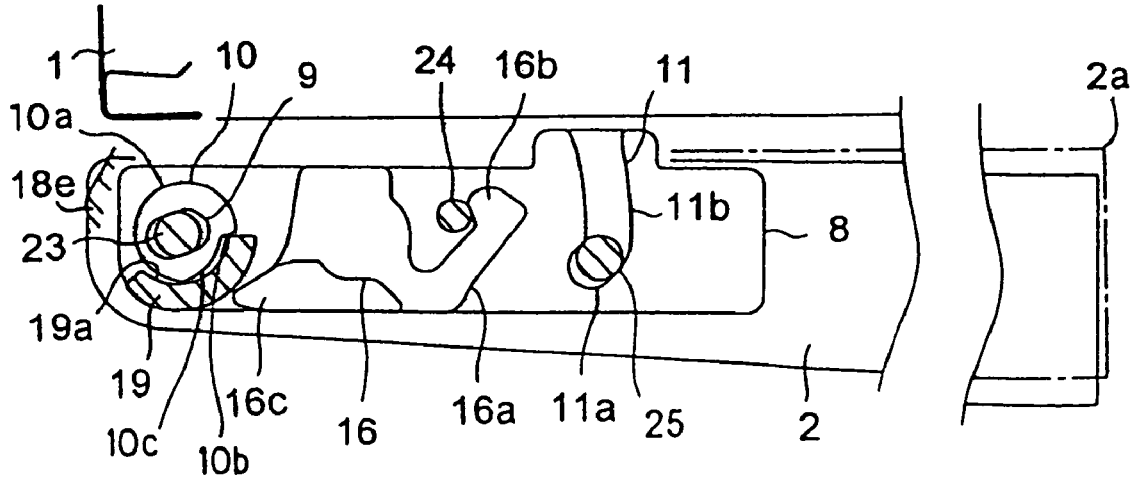
FIG. 14 is a plan view illustrating the operation of the door opening/closing mechanism of the first embodiment of the invention when the door is opened.

When the user, holding the handle 4 (see FIG. 1), starts opening the left door 2, as shown in FIG. 14, the arm portion 16*a* of the lock member 16 deforms elastically, and the lock pin 24 starts disengaging from the engagement portion 16*b*. If the user releases the handle 4 in this state, the elastic force of the arm portion 16*a* makes the left door 2 return to the state shown in FIG. 13. Thus, the lock member 16 and the lock pin 24 provide an automatically closing function, which ensures secure closing of the left door 2.

As the left door 2 is opened, it rotates. However, since the first cam surface 10*b* of the boss 10 engages with the rib 19, and the guide portion 11*a* of the guide groove 11 engages with the guide pin 25, the left door 2 cannot rotate about the hinge pin 23 as long as it remains in the first locked position.

Thus, the hinge pin 23 is guided by the hinge groove 9 relatively, and the rib 19 and the guide pin 25 are guided respectively by the first cam surface 10*b* and the guide portion 11*a* relatively. As a result, the left door 2, as it rotates, slides toward the lower left in the figure.

The cam mechanism may be designed to guide either only the guide pin 25 with the guide portion 11*a* of the guide groove 11 or only the rib with the first cam surface 10*b*. Even then, the cam mechanism permits the left door 2 to slide.

Figure 15:
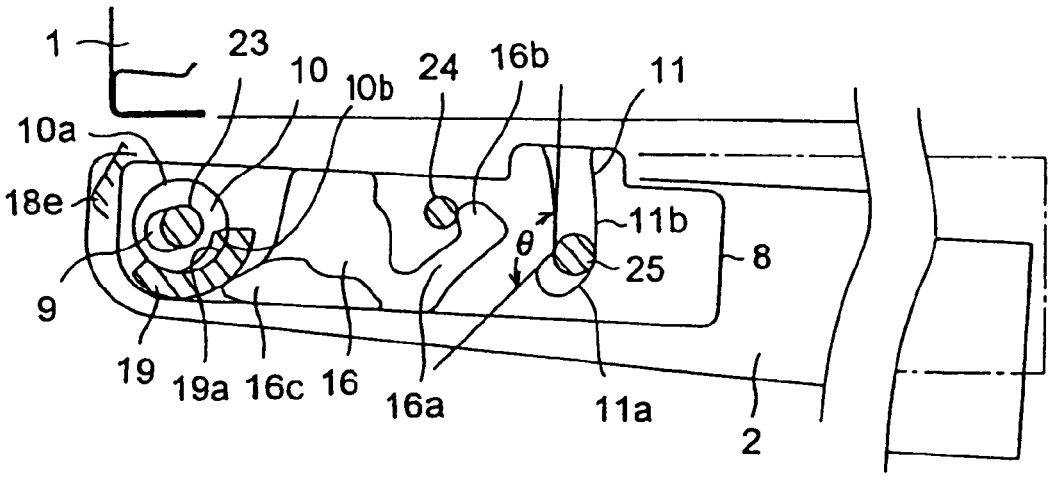
FIG. 15 is a plan view illustrating the operation of the door opening/closing mechanism of the first embodiment of the invention when the door is opened.

As the left door 2 is further opened, as shown in FIG. 15, the hinge pin 23 is locked at the other end of the hinge groove 9, and thus the cam mechanism is now in the second locked position. Then, the second cam surface 10*a* of the boss 10 starts sliding along the concave surface 19*a* of the rib 19. Thus, the cam mechanism maintains the second locked position, permitting the left door 2 to rotate about the hinge pin 23 as it is located in the second locked position.

The clearance portion 11*b* of the guide groove 11 is formed so as to have the shape of an arc about the hinge pin 23 as it is located in the second locked position. This permits the guide pin 25 to be released from the clearance portion 11*b*, and simultaneously guides the rotation of the left door 2, securely maintaining the second locked position.

Figure 16:
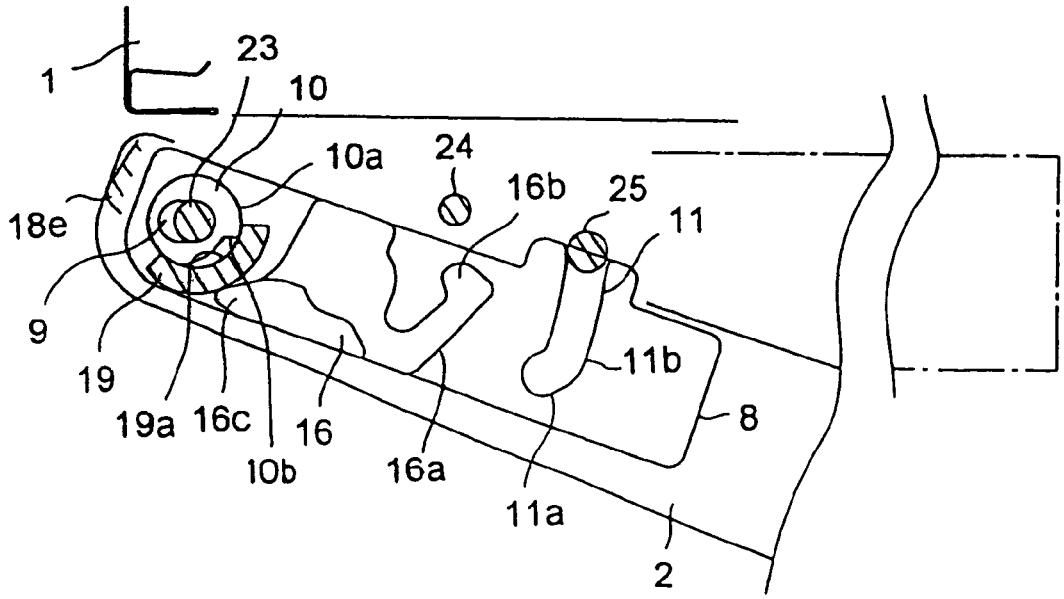
FIG. 16 is a plan view illustrating the operation of the door opening/closing mechanism of the first embodiment of the invention when the door is opened.

As the left door 2 is further opened, as shown in FIG. 16, the second cam surface 10*a* of the boss 10 continues sliding along the concave surface 19*a* of the rib 19, and the lock pin 24 disengages from the lock member 16, allowing the guide pin 25 to be released from the guide groove 11. This permits the left door 2 to be further opened. The concave surface 19*a* of the rib 19 has only to guide the boss 10, and therefore the rib 19 may be replaced with, for example, a plurality of pins arranged in an arc concentric with the hinge pin 23.

As the left door 2 is further opened, the restricting portion 16*c* of the lock member 16 makes contact with the stopper 18*e* of the lock cam member 18 (see FIGS. 8A to 8E), restricting the range in which the left door 2 can be opened. The left door 2 can be closed through the reversed flow of the operations described above and shown in FIGS. 13 to 16.

When the left door 2 is about to be fully closed, it is moved toward the right door 3 also by the attracting force of the magnets embedded in the gaskets 6 and 7.

In this embodiment, when the left door 2 starts opening, the cam mechanism shifts from the first locked position to the second locked position, permitting the left door 2 to slide as it rotates. This makes the left door 2 move away from the right door 3, and thus prevents the gaskets 6 and 7 (see FIG. 1) from rubbing against each other. As a result, no sliding friction appears between the gaskets 6 and 7, and therefore no great force is required to open and close the left door 2. This improves operability.

In a case where the gaskets 6 and 7 are not provided, even if the gap between the left and right doors 2 and 3 is made narrower, the left door 2 can be rotated without interference between the end 2*a* (see FIG. 14) of the left door 2 and the right door 3. This cam mechanism can be applied also in a case where the opening 1*a* is opened and closed with a single door and there is a wall surface or the like on the side at which the door opens. In this case, the door, by sliding, moves away from the wall surface or the like, and thereby prevents interference between the end of the door and the wall surface or the like.

Moreover, the cam mechanism permits the left door 2 to slide by guiding the hinge groove 9 with the hinge pin 23. This eliminates the need for a slide member for sliding the pivoted position of the door and a spring for recovering its original position as used in the conventional example, and thus helps reduce the number of parts needed. Furthermore, the weight of the left door 2 is borne by the hinge pin 23 provided on the part of the chassis 1. This reduces the contact area and the sliding friction, and in addition eliminates the need for a spring with a great elastic force. As a result, the door can be opened and closed with a small force. This further improves operability.

Moreover, the hinge groove 9 is formed with an inclination relative to the horizontal direction in the figure. Thus, during the shift from the first locked position to the second locked position, the left door 2 slides away from the chassis 1. This prevents the hermetic gaskets 41 and 44 (see FIG. 1) provided between the left door 2 and the chassis 1 from being compressed and broken, and also prevents the pivoted-side end of the left door 2 from colliding with the end of the opening 1*a* of the chassis 1.

Moreover, when the cam mechanism shifts from the first locked position to the second locked position, the guide pin 25 is guided by the guide portion 11*a* to move in the right/left and front/back directions relative to the left door 2. In the second locked position, the guide pin 25 is guided by the clearance portion 11*b* to move in the direction of rotation relative to the left door 2.

Thus, at the point at which the guide portion 11*a* and the clearance portion 11*b* cross each other, the larger the intersection angle θ (see FIG. 15) at which the tangent to the wall surface of the guide portion 11*a* intersects the tangent to the wall surface of the clearance portion 11*b*, the larger proportion of the force with which the left door 2 is opened and closed acts in the direction in which the guide portion 11*a* guides the hinge pin 23 (i.e., relatively, the direction in which the hinge pin 23 moves, specifically substantially the right/left direction), and the lower the sliding friction between the guide pin 25 and the wall surface of the guide portion 11*a*.

Setting the intersection angle θ within the range from 120° to 170° ensures smooth opening and closing of the left door 2. The intersection angle θ is determined appropriately according to the inclination of the hinge groove 9 and the distance between the hinge pin 23 and the guide pin 25.

Moreover, the greater the distance between the hinge pin 23 and the guide pin 25, the smaller the play resulting from the gap between the hinge pin 23 and the hinge groove 9 and the gap between the guide pin 25 and the guide groove 11, and thus the more stably the left door 2 can be opened and closed. By arranging the lock pin 24 in the space between the hinge pin 23 and the guide pin 25, it is possible to make effective use of the available space.

Moreover, the guide pin 25 is located more frontward than the hinge pin 23. This permits the clearance portion 11*b* of the guide groove 11 to be made sufficiently long. As a result, when the left door 2 is opened and closed, the engagement between the clearance portion 11*b* and the guide pin 25 can be maintained for a sufficiently long period. This permits the door to be kept in the second locked position securely, and thus permits the left door 2 to be opened and closed more stably.

Although the above descriptions deal only with the left door 2, the same effects as described above can be achieved also with the right door 3, which has a cam mechanism similar to that of the left door 2. Of each of the combinations of the hinge pin 23 and the hinge groove 9, the guide pin 51 and the guide groove 52, the rib 19 and the boss 10, and the guide pin 25 and the guide groove 11, one may be provided on the part of either of the chassis and the door, with its partner provided on the part of the other.

FIGS. 17 to 20 are plan views showing the operation of the cam mechanism of the door opening/closing mechanism of a second embodiment. For convenience's sake, such parts as are found also in the first embodiment shown in FIGS. 13 to 16 described already are identified with the same reference numerals. This embodiment differs from the first embodiment in that the guide pin 25 and the guide groove 11 are omitted. In other respects, this embodiment is the same as the first embodiment.

Moreover, just like FIGS. 13 to 16, FIGS. 17 to 20 show the cam mechanism provided at the bottom of the left door 2, and cam mechanisms similar to it are provided also at the top of the left door 2 and at the top and bottom of the right door 3 (see FIG. 1). Hatching indicates members provided on the part of the chassis 1.

Figure 17:
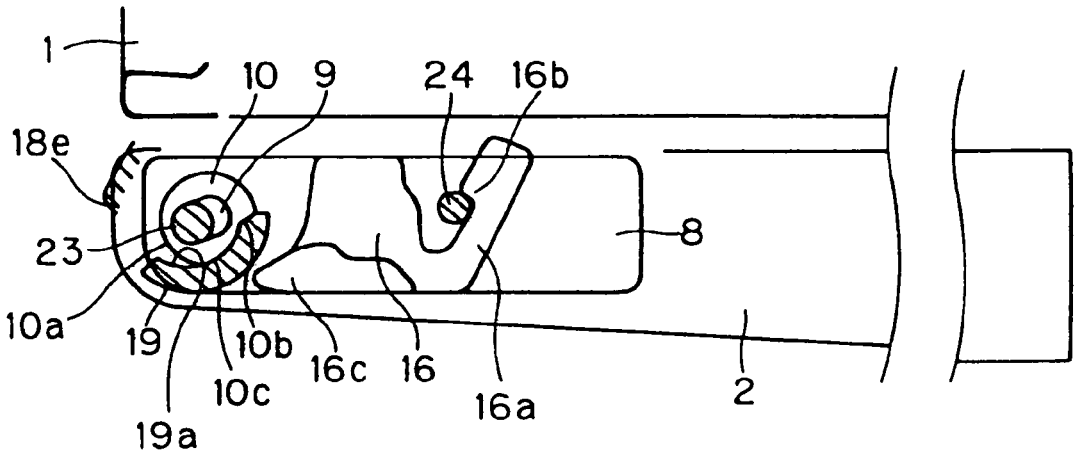
FIG. 17 is a plan view of the door opening/closing mechanism of a second embodiment of the invention, in the state in which the door is closed.

FIG. 17 shows the state in which the left door 2 is closed. With the left door 2 closed, the hinge pin 23 is locked at one end of the hinge groove 9, and the cam mechanism is in the first locked position. The lock pin 24 engages with the engagement portion 16*b* of the lock member 16, and the elastic force of the arm portion 16*a* loads the left door 2 with a force that tends to move it toward the right door 3 (see FIG. 1).

This permits a predetermined gap to be maintained between the left and right doors 2 and 3, and simultaneously prevents play of the left door ascribable to the gap between the hinge pin 10 and the hinge groove 9. In this way, the cam mechanism maintains the first locked position, keeping the left door 2 hermetically closed more securely than ever.

Figure 18:
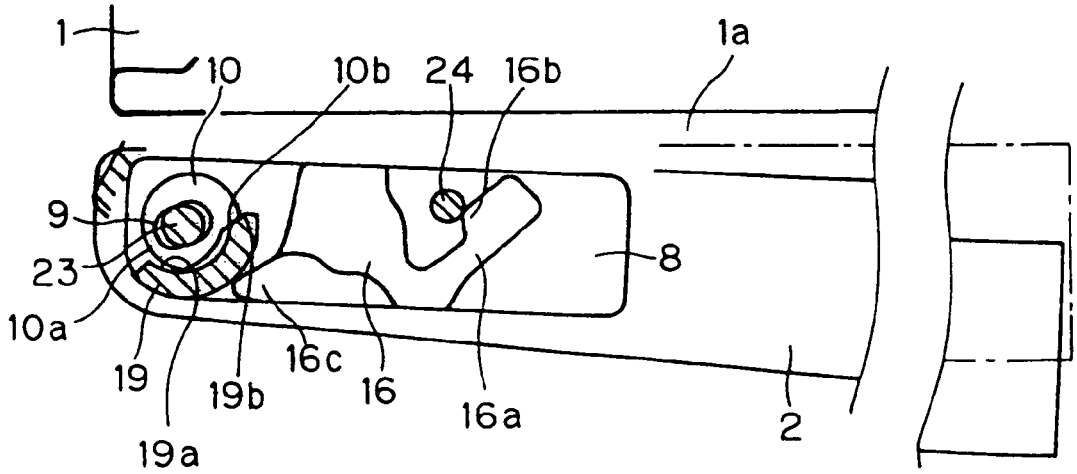
FIG. 18 is a plan view illustrating the operation of the door opening/closing mechanism of the second embodiment of the invention when the door is opened.

When the user, holding the handle 4 (see FIG. 1), starts opening the left door 2, as shown in FIG. 18, the arm portion 16*a* of the lock member 16 deforms elastically, and the lock pin 24 starts disengaging from the engagement portion 16*b*.

If the user releases the handle 4 in a state in which the portion making contact with the lock pin 24 near the engagement portion 16*b* is located on the opening 1*a* side of the line passing through the center axes of the hinge pin 23 and the lock pin 24 (i.e. at a stage slightly before the state shown in the figure), the elastic force of the arm portion 16*a* makes the left door 2 return to the state shown in FIG. 17. Thus, the lock member 16 and the lock pin 24 provide an automatically closing function, which ensures secure closing of the left door 2.

As in the first embodiment, around the elongate hinge groove 9 formed at one end of the bottom surface of the slide cam member 8, a boss having a second cam surface 10*a* is formed. The second cam surface 10*a* is a cylindrical surface about the hinge pin 23 as it is located in the second locked position. In the lock cam assembly (not shown), a rib 19 having a cylindrical concave surface 19*a* concentric with the hinge pin 23 is formed on the lock cam member (not shown).

The boss 10 has a first cam surface 10*b* formed thereon that is so inclined as to approach the opening 1*a* toward the middle of the opening 1*a*. The first cam surface 10*b* makes contact with a guide surface 19*b* formed at one end of the rib 19 with an inclination. Thus, as the left door 2 is opened, the first cam surface 10*b* slides along the guide surface 19*b*.

Thus, the hinge groove 9 moves toward the front left along the hinge pin 23. That is, the hinge pin 23 is guided by the hinge groove 9 relatively. As a result, the left door 2, as it rotates, slides toward the lower left in the figure. Meanwhile, the elastic force of the arm portion 16*a* acts against the movement of the left door 2.

Figure 19:
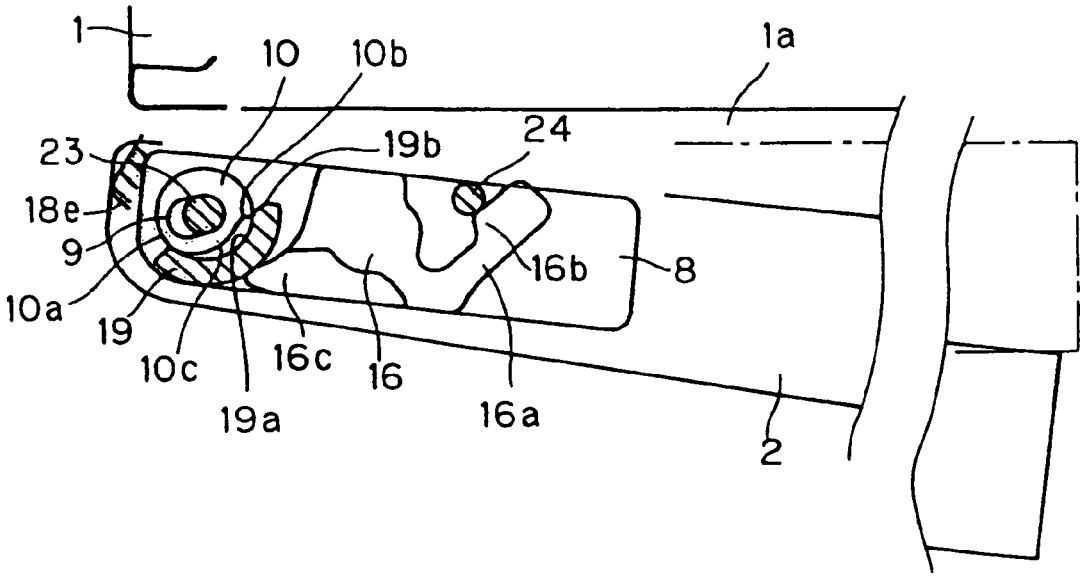
FIG. 19 is a plan view illustrating the operation of the door opening/closing mechanism of the second embodiment of the invention when the door is opened.

As the left door 2 is further opened, as shown in FIG. 19, the hinge pin 23 is locked at the other end of the hinge groove 9, and thus the cam mechanism is now in the second locked position. Then, the second cam surface 10*a* of the boss 10 starts sliding along the concave surface 19*a* of the rib 19. Thus, the cam mechanism maintains the second locked position, permitting the left door 2 to rotate about the hinge pin 23.

The first cam surface 10*b* is so formed as to be continuous with the second cam surface 10*a*, and thus it not only guides the rotation of the left door 2 but also permits the cam mechanism to shift securely to the second locked position. As the left door 2 is further opened, as shown in FIG. 20, the second cam surface 10*a* of the boss 10 continues sliding along the concave surface 19*a* of the rib 19, permitting the left door 2 to be further opened.

Figure 20:
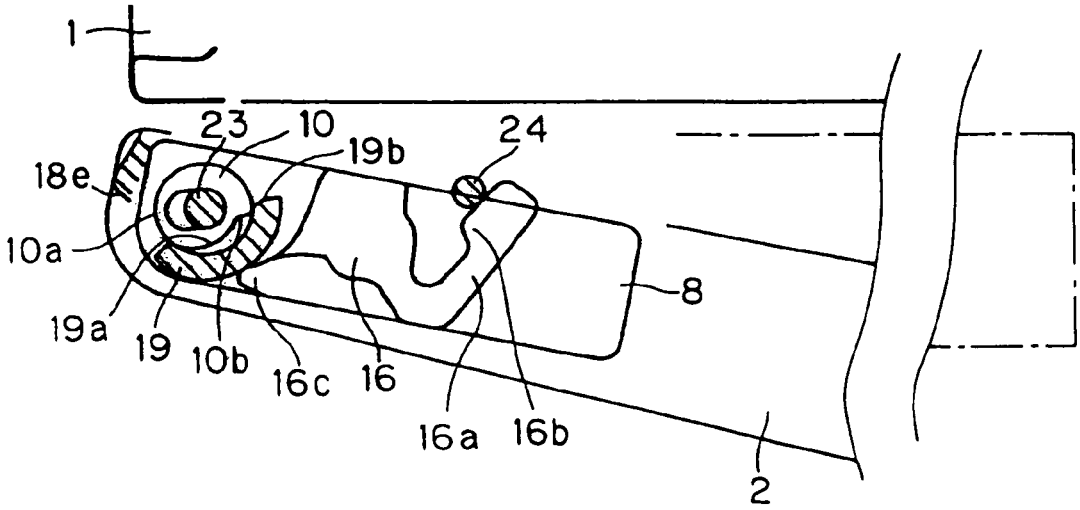
FIG. 20 is a plan view illustrating the operation of the door opening/closing mechanism of the second embodiment of the invention when the door is opened.

When the left door 2 is about to be fully closed, as shown in FIG. 20, the contact surface 16*d* of the lock member 16 makes contact with the lock pin 24. As the left door 2 is further closed, the elastic force of the arm portion 16*a* starts acting in such a direction as to move the left door 2 rightward in the figure. The contact surface 16*d* is formed by extending the engagement portion 16*b* of the lock member 16 (see FIG. 14) of the first embodiment, and serves to load the lock pin 24 with a force before the first cam surface 10*b* of the boss 10 starts sliding along the rib 19. This securely enables the left door 2 to slide.

Thereafter, as shown in FIG. 18, the first cam surface 10*b* of the boss 10 moves rightward along the guide surface 19*b* of the rib 19, and thus the left door 2, as it rotates, moves rightward into the closed state shown in FIG. 17.

Figure 21:
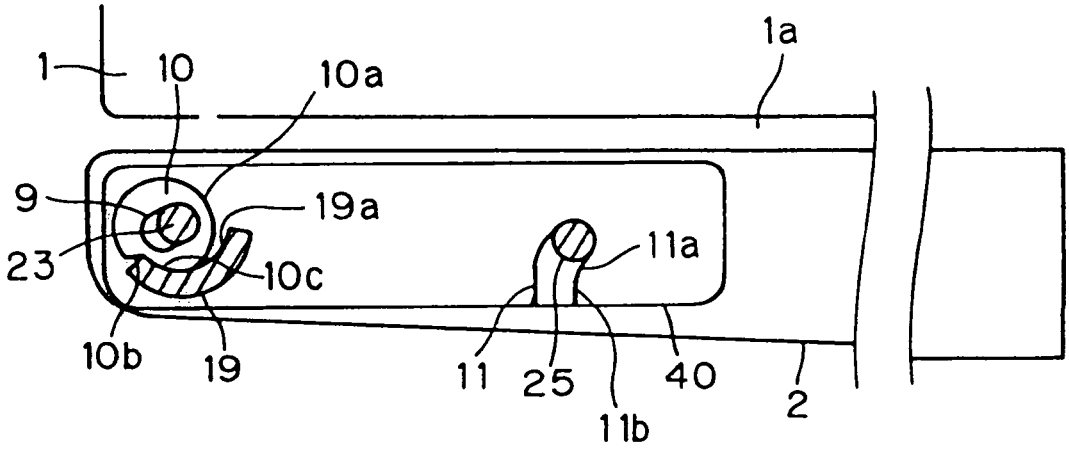
FIG. 21 is a plan view of the door opening/closing mechanism of a third embodiment of the invention, in the state in which the door is closed.
Figure 22:
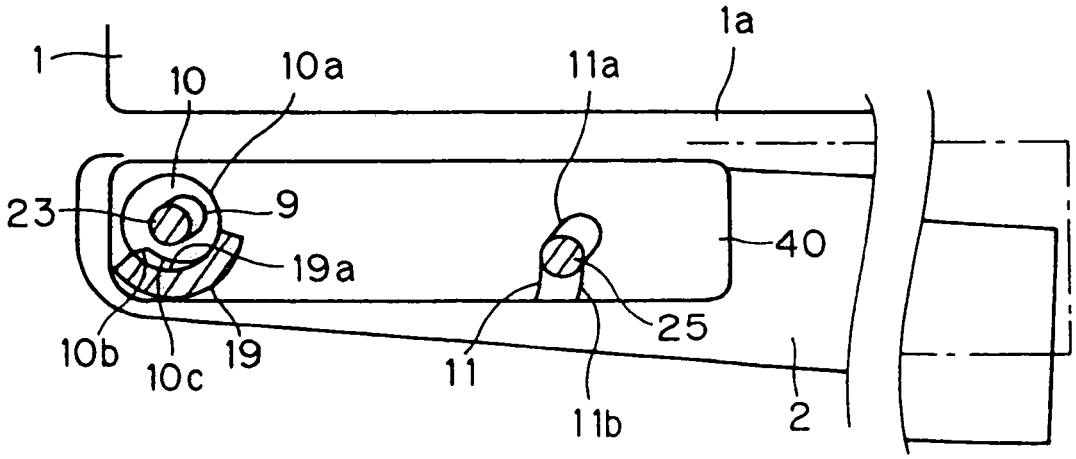
FIG. 22 is a plan view illustrating the operation of the door opening/closing mechanism of the third embodiment of the invention when the door is opened.

FIGS. 21 and 22 are plan views showing the operation of the cam mechanism of the door opening/closing mechanism of a third embodiment. For convenience's sake, such parts as are found also in the first embodiment shown in FIGS. 13 to 16 described already are identified with the same reference numerals. Just like FIGS. 13 to 16, FIGS. 21 and 22 show the cam mechanism provided at the bottom of the left door 2, and cam mechanisms similar to it are provided also at the top of the left door 2 and at the top and bottom of the right door 3 (see FIG. 1).

In this embodiment, the hinge pin 23, guide pin 25, and rib 19 are formed integrally with the left door 2, and the hinge groove 9, guide groove 11, and boss 10 are formed in a lock cam member 40 that is formed integrally with the chassis 1. Hatching indicates members arranged on the part of the left door 2.

FIG. 21 shows the state in which the left door 2 is closed. With the left door 2 closed, the hinge pin 23 is locked at one end of the hinge groove 9, and the cam mechanism is in the first locked position. The left door 2 is fixed to the chassis 1 by a holding means (not shown) such as a magnet provided on the rear surface thereof, and this enables the cam mechanism to maintain the first locked position.

Around the elongate hinge groove 9, a boss 10 is provided that has a shape substantially symmetric in the right/left direction with that of the first embodiment and that has a second cam surface 10*a* that is a cylindrical surface about the hinge pin 23 as it is located in the second locked position. On the slide cam member (not shown), a rib 19 having a cylindrical concave surface 19*a* concentric with the hinge pin 23 is formed The boss 10 has a first cam surface 10*b* formed thereon that is so inclined as to approach the opening 1*a* toward the middle of the opening 1*a*, and makes contact with the rib 19.

On the side of the hinge pin 23 closer to the middle of the opening 1*a*, a guide pin 25 is provided. In the lock cam member 40, a guide groove 11 for guiding the guide pin 25 is formed. The guide groove 11 has a guide portion 11*a* inclined in the same manner as in the first embodiment and a clearance portion 11*b* open away from the guide portion 11*a*.

As the left door 2 is opened, it rotates. However, since the first cam surface 10*b* of the boss 10 engages with the rib 19, and the guide portion 11*a* of the guide groove 11 engages with the guide pin 25, the left door 2 cannot rotate about the hinge pin 23 as long as it remains in the first locked position. Thus, the hinge pin 23 is guided by the hinge groove 9, and the rib 19 and the guide pin 25 are guided by the first cam surface 10*b* and the guide portion 11*a*, respectively. As a result, the left door 2, as it rotates, slides toward the lower left in the figure.

As the left door 2 is further opened, as shown in FIG. 22, the hinge pin 23 is locked at the other end of the hinge groove 9, and thus the cam mechanism is now in the second locked position. Then, the concave surface 19*a* of the rib 19 starts sliding along the second cam surface 10*a* of the boss 10. Thus, the cam mechanism maintains the second locked position, permitting the left door 2 to rotate about the hinge pin 23.

The left door 2 can be closed through the reversed flow of the operations described above. The lock mechanism may be composed of a lock pin and a lock cam as in the first embodiment.

FIGS. 23 to 26 are plan views showing the operation of the cam mechanism of the door opening/closing mechanism of a fourth embodiment. For convenience's sake, such parts as are found also in the first embodiment shown in FIG. 13 to 16 described already are identified with the same reference numerals. Just like FIGS. 13 to 16, FIGS. 23 to 26 show the cam mechanism provided at the bottom of the left door 2, and cam mechanisms similar to it are provided also at the top of the left door 2 and at the top and bottom of the right door 3 (see FIG. 1). Moreover, as described earlier, hatching indicates members arranged on the part of the left door 2.

In this embodiment, in addition to the structure of the first embodiment, a guide cam 53 is provided at the open side of each of the left and right doors 2 and 3. In other respects, this embodiment is the same as the first embodiment. The guide cam 53 is a resin molding, and has a bent guide groove 52 formed therein. To the chassis 1 is fitted, by being supported by an angle (not shown), a guide pin 51 that engages with the guide groove 52 and that is made of, for example, stainless steel.

The guide groove 52 has a guide portion 52*a* that guides the guide pin 51 from a first locked position to a second locked position relatively, a clearance portion 52*b* that permits the guide pin 51 to be released relatively in the second locked position, and an arc portion 52*c* formed so as to extend from the end of the guide portion 52*a* along an arc about the hinge pin 23 as it is located in the first locked position.

Figure 23:
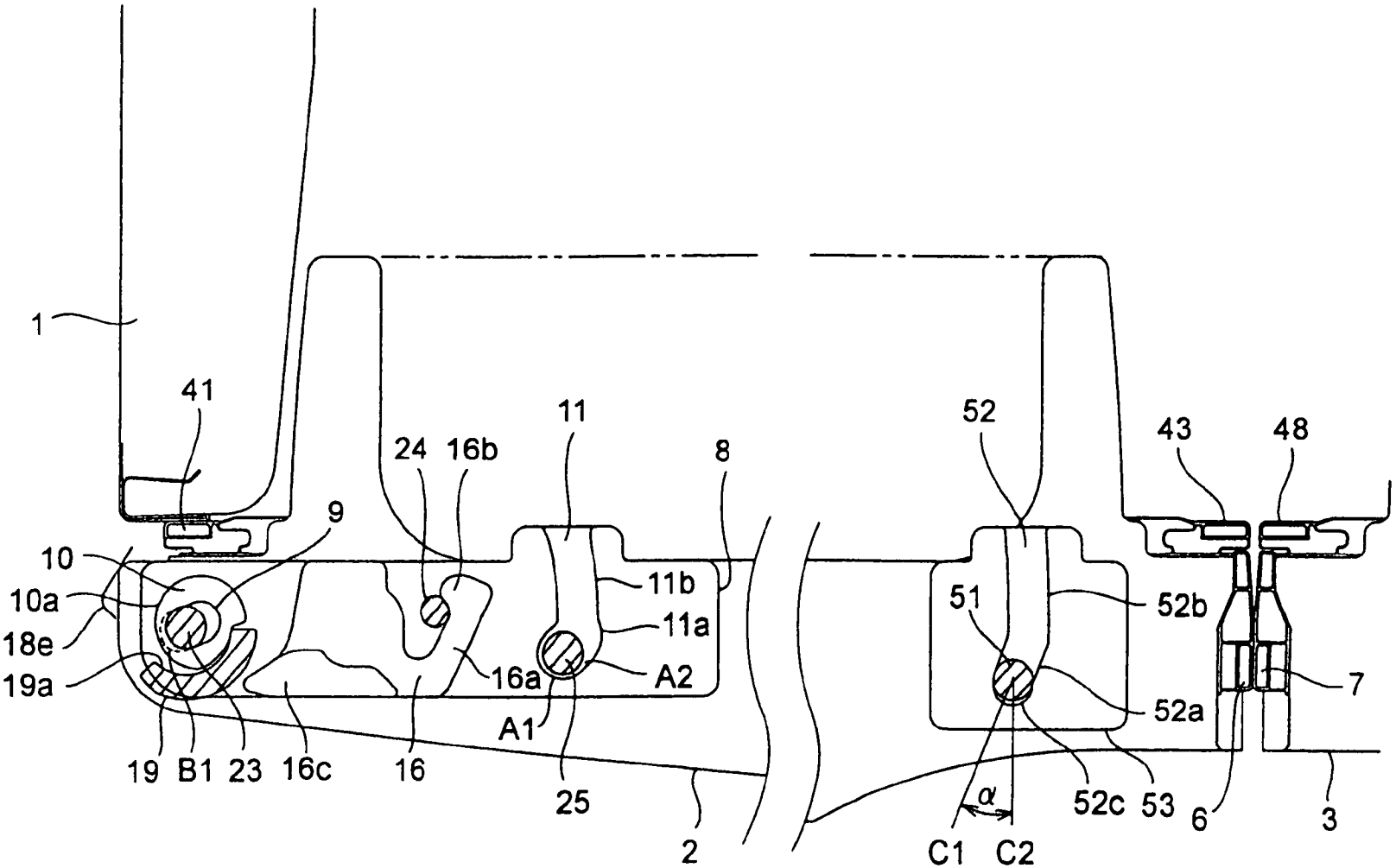
FIG. 23 is a plan view showing the operation of the cam mechanism of the door opening/closing mechanism of a fourth embodiment of the invention.

FIG. 23 shows the state in which the left door 2 is closed. With the left door 2 closed, the hinge pin 23 is locked at one end of the hinge groove 9, and the cam mechanism is in the first locked position. In the first locked position, the open-side guide pin 51 is located at the end of the guide portion 52*a* of the guide groove 52, and the pivoted-side guide pin 25 is located at the end of the guide portion 11*a* of the guide groove 11.

Since the arc portion 52*c* of the guide groove is formed along an arc about the hinge pin 23 as it is located in the first locked position, the left door 2, in the first locked position, can rotate about the hinge pin 23 in the direction in which it closes. This ensures secure closing of the left door 2 in the first locked position.

To prevent, in this state, the guide portion 11*a* of the pivoted-side guide groove 11 from making contact with the guide pin 25 and thereby restricting the rotation of the left door 2, between the open-side guide pin 25 and the guide portion 11*a* in the first locked position are secured gaps A1 and A2 in the length and width directions of the groove, respectively.

The lock pin 24 engages with the engagement portion 16*b* of the lock member 16, and the elastic force of the arm portion 16*a* loads the left door 2 with a force that tends to move it toward the right door 3 (see FIG. 1). This permits a predetermined gap to be maintained securely between the left and right doors 2 and 3, and simultaneously prevents play of the left door 2 ascribable to the gap secured to permit the fitting between the hinge pin 23 and the hinge groove 9. In this way, the cam mechanism maintains the first locked position, keeping the left door 2 hermetically closed more securely than ever.

When the user, holding the handle 4 (see FIG. 1), starts opening the left door 2, the left door 2, as it is opened, rotates. However, since the guide portion 52*a* of the guide groove 52 engages with the guide pin 51, the left door 2 cannot rotate about the hinge pin 23 as long as it remains in the first locked position.

Thus, the hinge pin 23 is guided by the hinge groove 9 relatively, and the guide pin 51 is guided by the guide portion 52*a*. Moreover, the gap A2 secured in the guide portion 11*a* of the guide groove 11 prevents the relative movement of the guide pin 25 from being restricted.

As a result, the left door 2, as it rotates, slides away from the right door 3 (leftward in the figure). Thus, the gasket 6 provided on the left door 2 moves away from the gasket 7 provided on the right door 3. This prevents the gaskets 6 and 7 from rubbing against each other and thereby being damaged. Moreover, the reduced sliding friction reduces the force required to open the door.

Moreover, tithe arm portion 16*a* of the lock member 16 deforms elastically, and the lock pin 24 starts disengaging from the engagement portion 16*b*. If the user releases the handle 4 in this state, the elastic force of the arm portion 16*a* makes the left door 2 return to the state shown in FIG. 23. Thus, the lock member 16 and the lock pin 24 provide an automatically closing function, which ensures secure closing of the left door 2.

Figure 24:
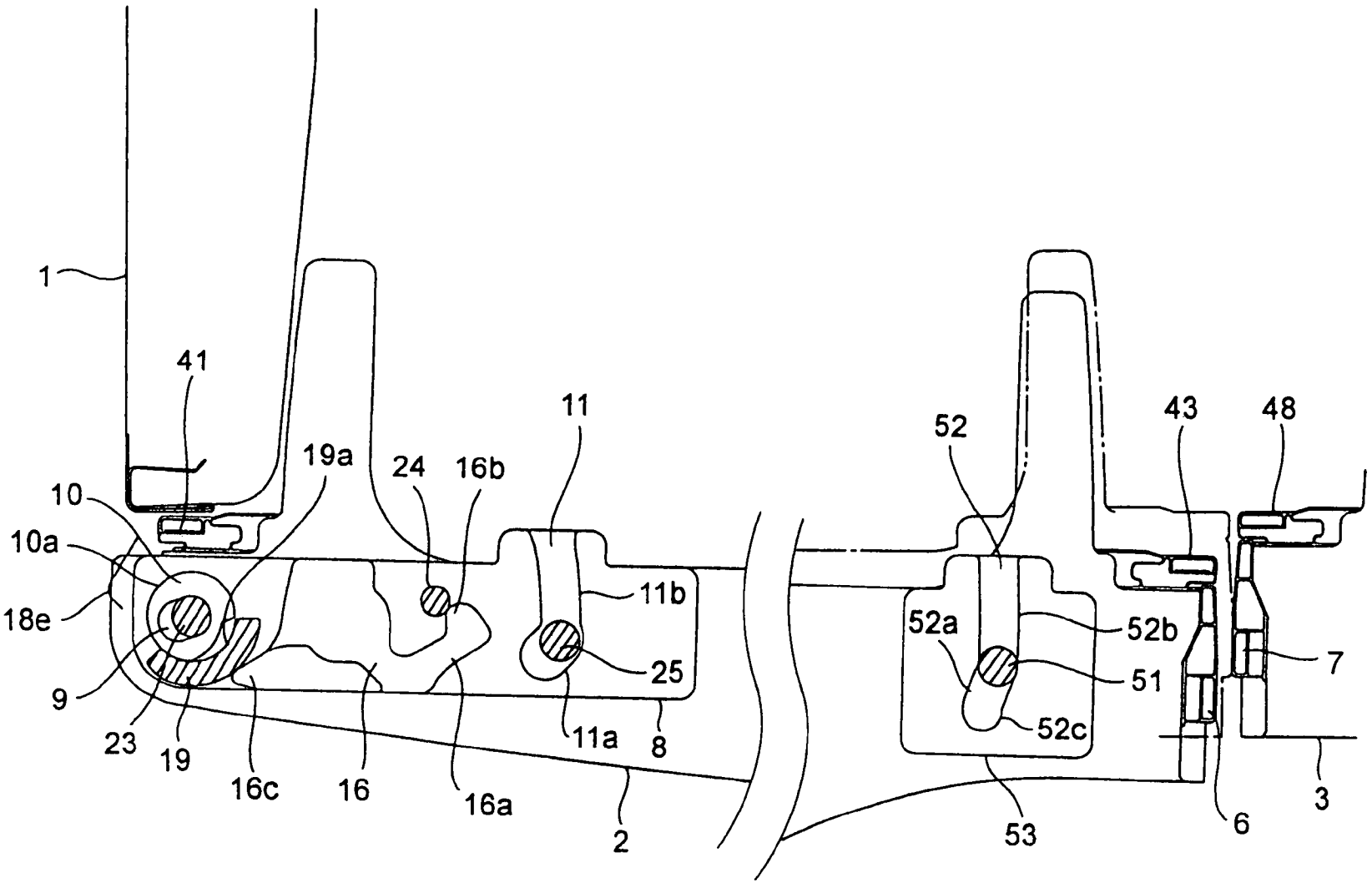
FIG. 24 is a plan view showing the operation of the cam mechanism of the door opening/closing mechanism of the fourth embodiment of the invention.

As the left door 2 slides while rotating, as shown in FIG. 24, the hinge pin 23 is locked at the other end of the hinge groove 9, and thus the cam mechanism is now in the second locked position. Moreover, the second cam surface 10*a* of the boss 10 starts sliding along the concave surface 19*a* of the rib 19.

At this point, the guide pins 51 and 25 are located at the intersections between the guide portions 52*a* and 11*a* and the clearance portions 52*b* and 11*b* of the guide grooves 52 and 11, respectively. The clearance portions 52*b* and 11*b* of the guide grooves 52 and 11 are formed so as to describe arcs about the hinge pin 23 as it is located in the second locked position, and serve to permit the guide pins 51 and 25 to be released relatively and simultaneously guide the rotation of the left door 2 so that the second locked position is maintained securely.

Figure 25:
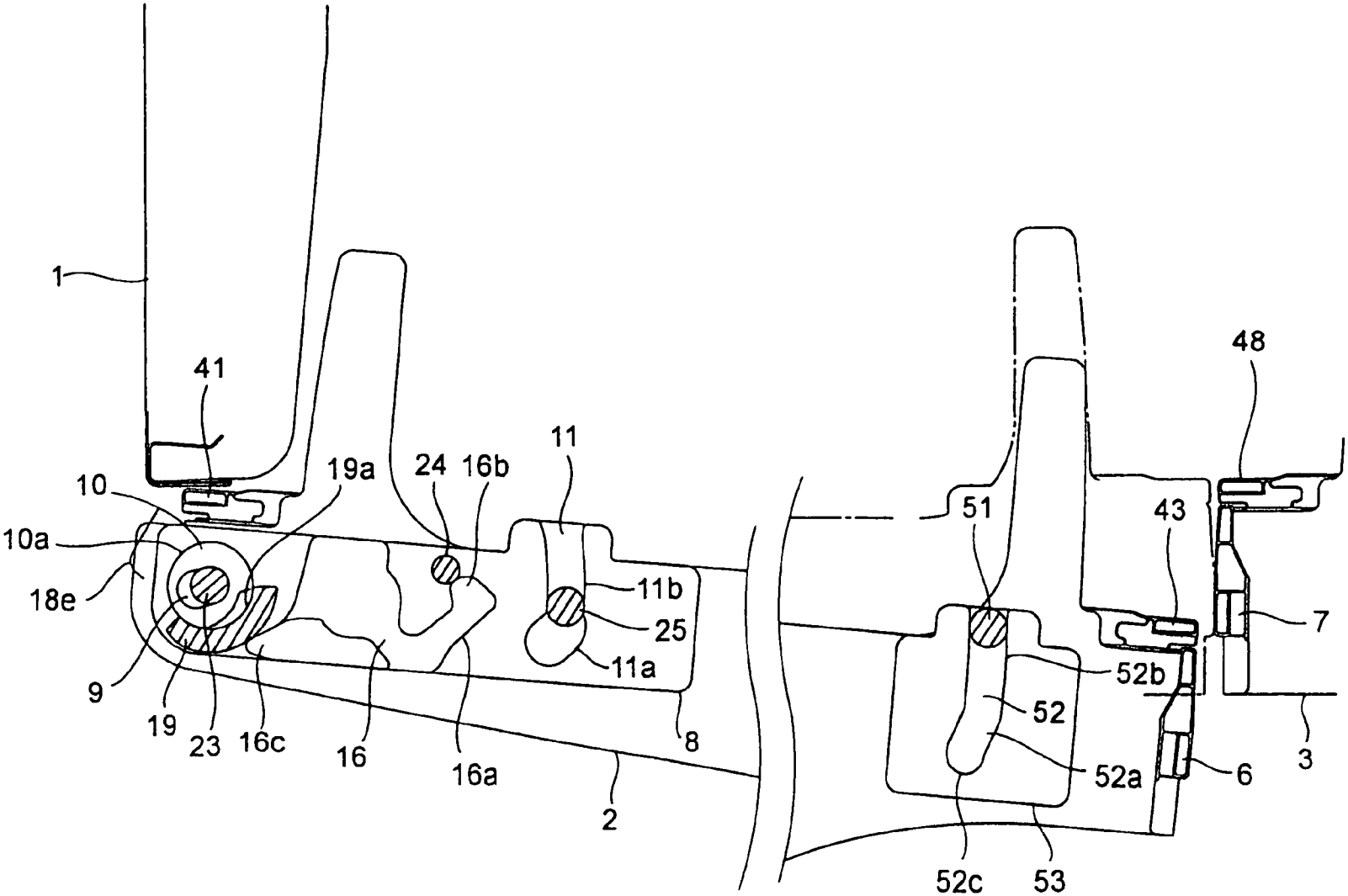
FIG. 25 is a plan view showing the operation of the cam mechanism of the door opening/closing mechanism of the fourth embodiment of the invention.

As the left door 2 is further opened, as shown in FIG. 25, the second cam surface 10*a* of the boss 10 slides in two places on the concave surface 19*a* of the rib 19, inhibiting the boss 10 from moving in the length direction of the hinge groove 9. This permits the cam mechanism to maintain the second locked position, and permits the left door 2 to be pivoted. The concave surface 19*a* of the rib 19 has only to guide the boss 10, and therefore the rib 19 may be replaced with, for example, a plurality of pins arranged in an arc concentric with the hinge pin 23.

Moreover, the guide groove 52 guides the guide pin 51 relatively so that, while the cam mechanism maintains the second locked position, the left door 2 rotates. Since the gaps A1 and A2 (see FIG. 5) are secured between the guide portion 11*a* of the guide groove 11 and the guide pin 25, first the clearance portion 52*b* of the guide groove 52 starts engaging with the guide pin 51, and then the clearance portion 11*b* of the guide groove 11 starts engaging with the guide pin 25.

Figure 26:
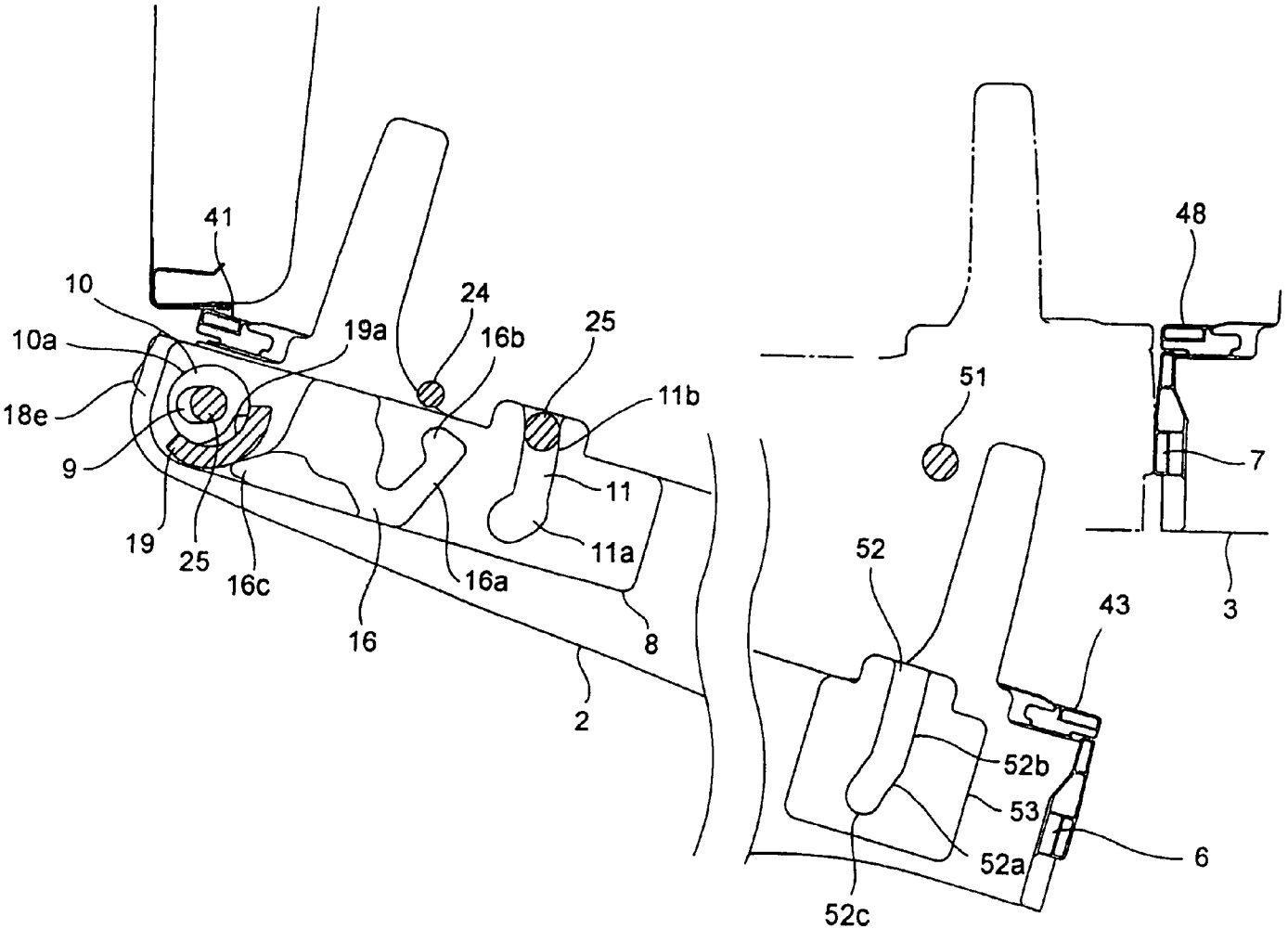
FIG. 26 is a plan view showing the operation of the cam mechanism of the door opening/closing mechanism of the fourth embodiment of the invention.

As the left door 2 is further opened, as shown in FIG. 26, the guide groove 52 disengages from the guide pin 51. Thereafter, while the cam mechanism maintains the second locked position with the guide groove 11 guiding the guide pin 25 relatively, the left door 2 rotates. Moreover, the lock pin 24 disengages from the lock member 16.

Here, errors in the fitting of the guide cam 53 or the guide pin 25 or in the dimensions of the guide cam may cause the distance between the guide pin 51 and the guide pin 25 to be unequal to the distance between the corresponding points of the clearance portions 11*b* and the 51*b*. In that case, as long as the engagement between the guide groove 52 and the guide pin 51 and the engagement between the guide groove 11 and the guide pin 25 are maintained concurrently, those errors increase, for example, the sliding friction between the guide groove 52 and the guide pin 51 and thereby make it impossible to open the left door 2 smoothly.

To avoid this, the gap between the clearance portion 11*b* and the guide pin 25 is so set as to be large during the period in which the clearance portion 52*b* is engaged with the guide pin 51 and small during the period after the clearance portion 52*b* has disengaged from the guide pin 51. By varying the gap between the clearance portion 11*b* and the guide pin 25, it is possible to avoid the influence of fitting errors and thereby ensure smooth rotation of the left door 2.

It is to be noted that the same effect is achieved by setting the gap between the clearance portion 52*b* and the guide pin 51 so that it is small before the clearance portion 11*b* starts engaging with the guide pin 25 and large after the clearance portion 11*b* has started engaging with the guide pin 25.

As the left door 2 is further opened, the restricting portion 16*c* of the lock member 16 makes contact with the stopper 18*e* of the lock cam member 18 (see FIGS. 8A to 8E), restricting the range in which the left door 2 can be opened. The left door 2 can be closed through the reversed flow of the operations described above and shown in FIGS. 23 to 26.

In this embodiment, it is possible not only to achieve the same effects as in the first embodiment, but also to enhance the operability of the door opening/closing mechanism. Specifically, the guide pin 51 and the guide cam 53 for guiding the sliding from the first locked position to the second locked position are provided at the open side of the left door 2.

The angle $\alpha$ (see FIG. 23) between the length direction C1 (see FIG. 23) of the guide portion 52*a* of the guide groove 52 and the direction C2 (see FIG. 23) in which the force pulling the handle 4 acts is smaller here than when the guide pin 51 and the guide cam 53 are arranged at the pivoted side. This helps reduce the sliding friction between the guide pin 51 and the guide groove 52, and thus helps reduce the force required to open and close the door. This enhances the operability of the door opening/closing mechanism.

Moreover, the cam mechanism is positioned in the first locked position with the hinge groove 9 locked with the hinge pin 23 provided at the pivoted side of the left door 2 and with the guide pin 51 engaged with the guide groove 52. Errors in the fitting of the guide pin 51 or the guide cam 53 or in the dimensions of the guide cam 53 may cause the left door 2 to be slightly open from the predetermined closed position when the guide pin 51 is located at the end of the guide portion 52*a*.

In a case where the guide pin 51 and the guide cam 53 are provided at the pivoted side, in the aforementioned position, the left door 2 is open to a degree commensurate with such errors, and these errors are magnified at the open side of the left door 2. By contrast, in a case where the guide pin 51 and the guide cam 53 are provided at the open side of the left door 2 as in this embodiment, the degree to which the door is open at the open end is substantially commensurate with the errors, and is thus smaller than in a case where those components are provided at the pivoted side. Thus, the deviation from the predetermined closed position due to the errors can be absorbed by the gaskets 41 to 46. This makes it possible to securely maintain hermitically closed state.

Here, forming an arc portion 52*c* (see FIG. 23) in the guide groove 52 as described earlier makes it possible to rotate the left door 2 already in the first locked position further in the direction in which it is closed. This helps keep the left door 2 hermetically closed more securely.

Instead of forming the arc portion 52*c*, the guide portion 52*a* may be simply extended in the length direction C1 thereof. Specifically, by making the length-direction dimension of the guide portion 52*a* longer than the distance traveled by the guide pin 51 when it moves from the first locked position to the second locked position relatively, a gap is secured in the length direction C1 of the guide portion 52*a* between the guide pin 51 and the guide groove 52 in the first locked position, where the guide pin 51 is usually located.

In this way, even when there are errors in the fitting of the guide pin 51 or the guide cam 53 or in the dimensions of the guide cam 53, the left door 2 can move toward the right door 3 and in the front/back direction so far as the gap permits it to, allowing the hinge pin 23 to reach the predetermined first locked position. This helps keep hermetic contact between the left door 2 and the chassis 1, and helps maintain a predetermined distance between the left door 2 and the right door 3.

Moreover, as indicated by a broken line B1 in FIG. 23, the hinge groove 9 may be extended in the length direction thereof. Specifically, by making the length-direction dimension of the hinge groove 9 longer than the distance traveled by the hinge pin 23 when it moves from the first locked position to the second locked position relatively, a gap is formed in the length direction of the hinge groove 9 between the hinge pin 23 and the hinge groove 9 in the first locked position, where the hinge pin 23 is usually located.

In this case, the first locked position is determined by the engagement between the guide pin 51 and the guide groove 52 substantially in the right/left direction of the figure and by the engagement between the hinge pin 23 and the hinge groove 9 substantially in the front/back direction of the figure.

In this way, even when there are errors in the fitting of the guide pin 51 or the guide cam 53 or in the dimensions of the guide cam 53, the left door 2 can move toward the right door 3 and in the front/back direction so far as the gap permits it to. This helps keep hermetic contact between the left door 2 and the chassis 1, and helps maintain a predetermined distance between the left door 2 and the right door 3.

It is to be noted that, in this case, the hinge pin 23 is not located in the predetermined first locked position, but the first locked position of the cam mechanism is located where a balance is achieved between the elastic forces of the gaskets 41 to 43, 6, and 7 and the magnetic forces of the magnets embedded in those gaskets.

Figure 27:
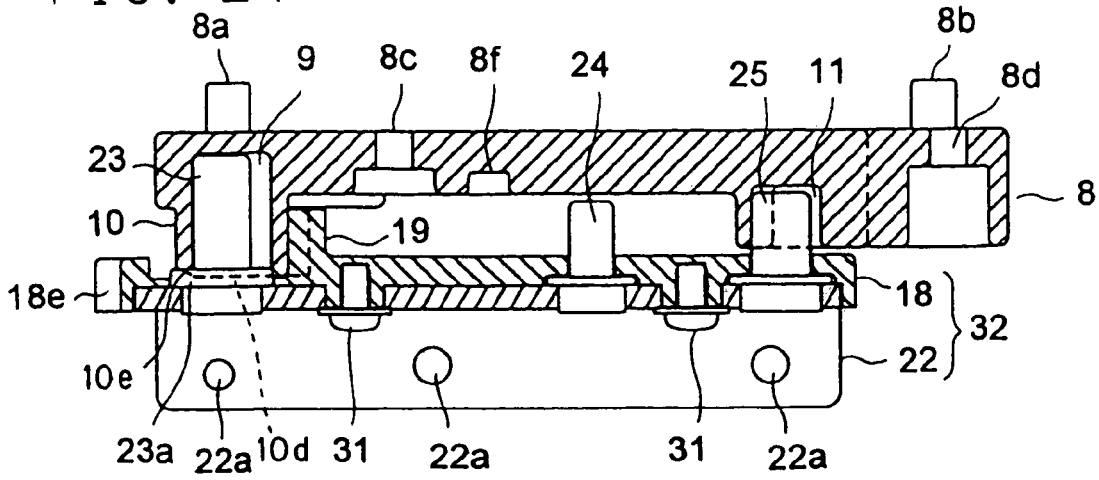
FIG. 27 is a sectional view as viewed from the front showing the cam mechanism of the door opening/closing mechanism of a fifth embodiment of the invention.

FIG. 27 is a sectional view as viewed from the front showing the cam mechanism of the door opening/closing mechanism of a fifth embodiment. For convenience's sake, such parts as are found also in the first embodiment shown in FIG. 13 to 16 described already are identified with the same reference numerals. Just like FIGS. 13 to 16, FIG. 27 shows the cam mechanism provided at the bottom of the left door 2, and cam mechanisms similar to it are provided also at the top of the left door 2 and at the top and bottom of the right door 3 (see FIG. 1). This embodiment differs from the first embodiment in that the boss 10 has a lowered portion 10*d* formed on the bottom surface 10*e* thereof. In other respects, this embodiment is the same as the first embodiment.

The cam mechanism is composed of a slide cam member 8 fitted to the left door 2 and a lock cam assembly 32 fitted to the chassis 1. The slide cam member 8, which is a resin molding, has bosses 8*a* and 8*b* formed on the top surface thereof, and has screw holes 8*c* and 8*d* formed therethrough.

The slide cam member 8 is fitted on the bottom surface of the left door 2 with the bosses 8*a* and 8*b* fitted into boss holes (not shown) formed in the bottom surface of the left door 2 and with self-tapping screws (not shown) screwed through the screw holes 8*c* and 8*d* from below in the figure. The slide cam member 8 also has a boss hole 8*f* formed therein to permit a lock member 16, described later, to be positioned.

The lock cam assembly 32 is composed of a lock cam member 18 and an angle 22 fitted together with screws 31 so as to form a single unit, and, by engaging with the slide cam member 8, forms the cam mechanism. The lock cam member 18 is a resin molding, and the angle 22, which needs to bear the weight of the left door 2, is a metal member.

The angle 22 has screw holes 22*a* formed in three places. With self-tapping screws screwed through the screw holes 22*a*, the angle 22, and thus the lock cam assembly 32, is fitted to the chassis 1. Moreover, a hinge pin 23, a lock pin 24, and a guide pin 25, each formed out of, for example, metal such as stainless steel, are swaged onto the angle 22 to form a single unit. The hinge pin 23, lock pin 24, and guide pin 25 each penetrate the lock cam member 18 and protrude upward in the figure.

Figure 28A:
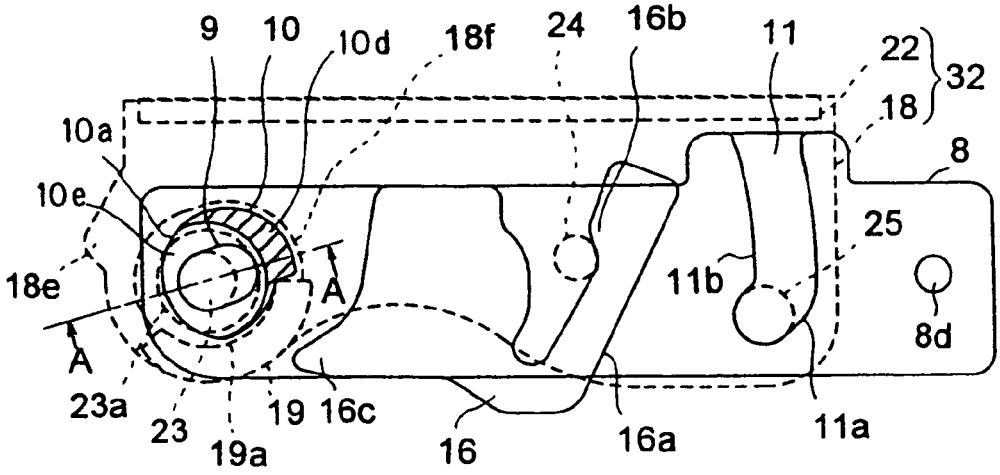
FIG. 28A is a plan view of the cam mechanism of the fifth embodiment of the invention in a first position.
Figure 28B:
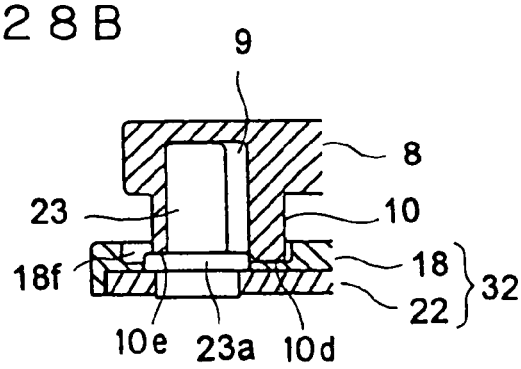
FIG. 28B is a sectional view taken along line A-A in FIG. 28A.

FIG. 28A is a plan view of the cam mechanism. This figure shows the state in which the left door 2 is closed, with broken lines indicating the lock cam assembly 32 and solid lines indicating the slide cam member 8. FIG. 28B is a sectional view along line A-A in FIG. 28A. A lock member 16 is fitted to the slide cam member 8. The lock member 16, which is a resin molding, has a boss (not shown) formed on the top surface thereof so that the lock member 16 is fitted to the slide cam member 8 with a self-tapping screw with the boss fitted into a boss hole 8*f* (see FIG. 27) formed in the bottom surface of the slide cam member 8.

At one end of the lock member 16, an arm portion 16*a* is formed so as to extend therefrom. The arm portion 16*a* elastically deforms under a load that acts on it substantially perpendicularly to the direction in which it extends. At the end of the arm portion 16*a*, an engagement portion 16*b* is formed that engages with a lock pin 24. At the other end of the lock member 16, a restricting portion 16*c* is formed that makes contact with a stopper 18*e* formed on the lock cam member 18 and thereby restricts the rotation of the left door 2.

At one end of the bottom surface of the slide cam member 8, a hinge groove 9 having the shape of an elongate hole is formed. Around the hinge groove 9, a boss 10 is formed that has a second cam surface 10*a* formed thereon about the hinge pin 23 as it is located in the second locked position described later.

The hinge pin 23 has a base portion 23*a* formed concentrically at the bottom. The boss 10 has a lowered portion 10*d* (hatched in FIG. 28A) formed so as to protrude below the bottom surface 10*e* thereof. The inner edge of the lowered portion 10*d* is formed along the base portion 23*a*, and is chamfered where it makes contact with the periphery of the base portion 23*a*.

The bottom surface 10*e* of the boss 10 mounts on the base portion 23*a*. In the portion of the lock cam member 18 surrounding the base portion 23*a*, a recess 18*f* is formed to avoid interference with the lowered portion 10*d*. The chamfering permits the lowered portion 10*d* to easily mount on the base portion 23*a*, and thus the chamfering may be formed in the top surface of the base portion 23*a* instead. In FIG. 28A, the inner edge of the chamfering is not shown, because it overlaps with the outline of the base portion 23*a*.

In the portion of the lock cam member 18 surrounding the hinge pin 23, a rib 19 is formed that has a cylindrical concave surface 19*a* concentric with the hinge pin 23. On the side of the hinge groove 9 closer to the middle of the opening 1*a* (see FIG. 1), a guide groove 11 bent into the shape of an inverted L is formed. The guide groove 11 has a guide portion 11*a* and a clearance portion 11*b*. The guide portion 11*a* guides a guide pin 25 relatively in such a way as to move it from the first to the second locked position described later. The clearance portion 11*b* permits the guide pin 25 to be released therefrom relatively in the second locked position.

Figure 29A:
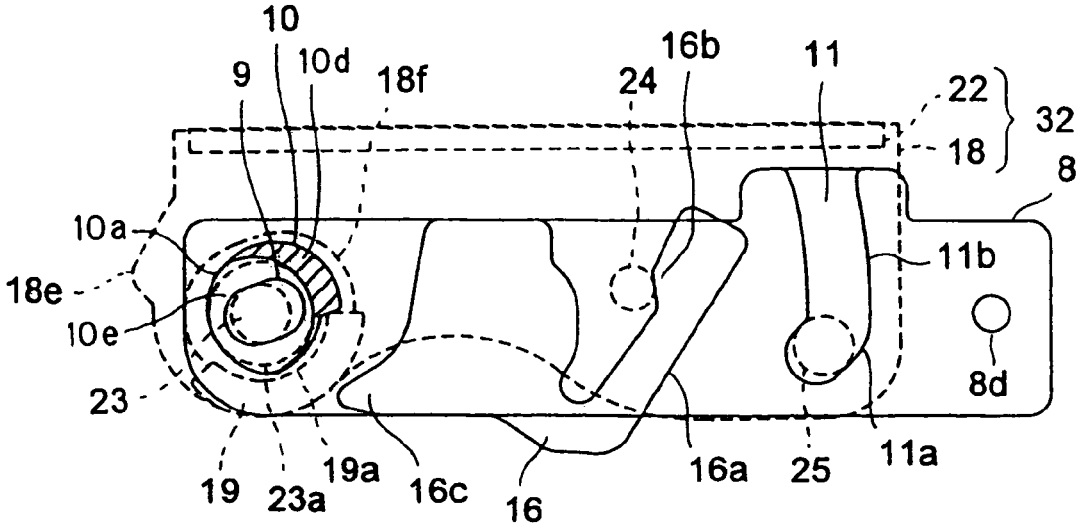
FIG. 29A is a plan view of the cam mechanism of the fifth embodiment of the invention in a second position.

Next, the operation of the cam mechanism provided at the bottom of the left door 2 will be described with reference to FIGS. 28A to 30B. The cam mechanisms provided in the other places operate in similar manners. FIGS. 29A and 30A are plan views, and FIGS. 29B and 30B, like FIG. 28B, are sectional views along the length direction of the hinge groove 9. In FIGS. 29A and 30B, the inner edge of the chamfering of the lowered portion 10*d* is omitted to avoid complicating the figures.

As described earlier, FIGS. 28A and 28B show the state in which the left door 2 is closed. With the left door 2 closed, the hinge pin 23 is locked at one end of the hinge groove 9, and the cam mechanism is in the first locked position. In the first locked position, the bottom surface 10*e* of the boss 10 mounts on the base portion 23*a* of the hinge pin 23, and the lowered portion 10*d* is located below the base portion 23*a*. The guide pin 25 is located at the end of the guide portion 11*a* of the guide groove 11.

Moreover, with the left door 2 closed, a gap may be secured between the hinge groove 9 and the hinge pin 23 or between the guide portion 11*a* of the guide groove 11 and the guide pin 25 in the direction of their movement. The gap absorbs errors in the dimensions of the hinge pin 23 or the guide pin 25, and thus permits secure closing in the first locked position.

The lock pin 24 engages with the engagement portion 16*b* of the lock member 16, and the elastic force of the arm portion 16*a* loads the left door 2 with a force that tends to move it toward the right door 3 (see FIG. 1). This permits a predetermined gap to be maintained between the left and right doors 2 and 3, and simultaneously prevents play of the left door 2 ascribable to the gap between the hinge pin 25 and the hinge groove 9.

In this way, the cam mechanism maintains the first locked position, keeping the left door 2 hermetically closed more securely than ever.

Figure 29B:
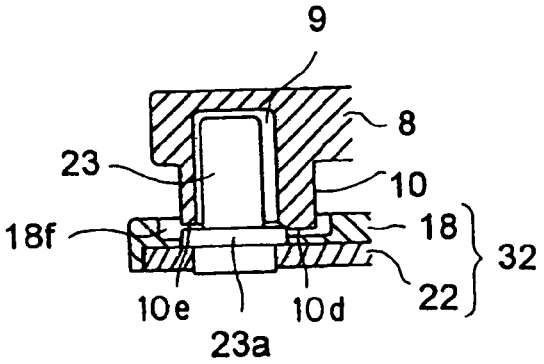
FIG. 29B is a sectional view taken through pin 23 of FIG. 29A.
Figure 30A:
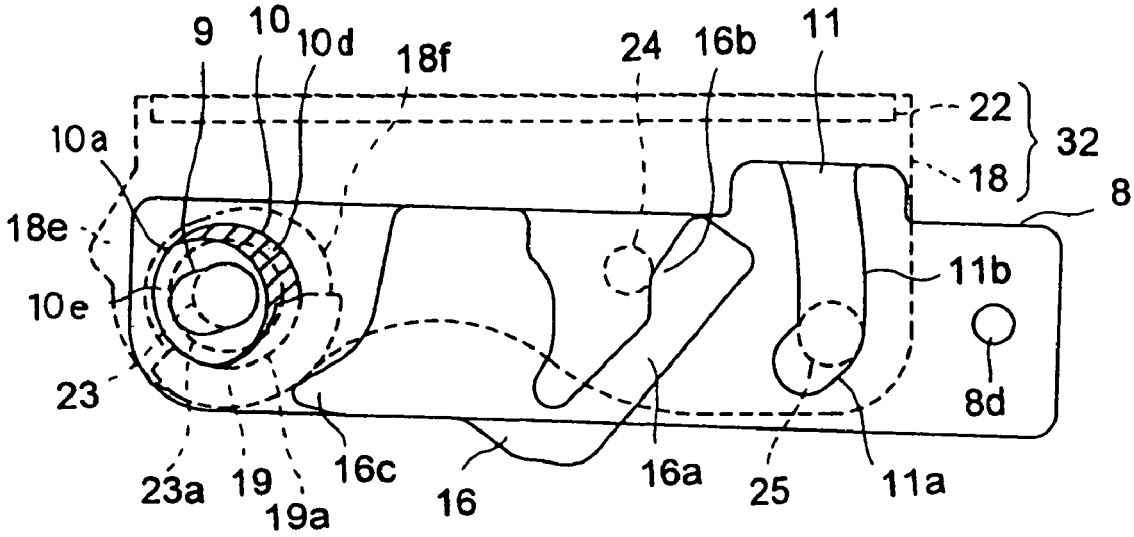
FIG. 30A is plan view of the cam mechanism of the fifth embodiment of the invention in a third position.
Figure 30B:
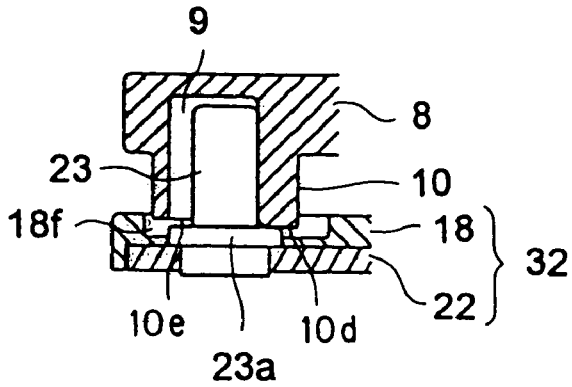
FIG. 30B is a sectional view taken through pin 23 of FIG. 30A.

When the user, holding the handle 4 (see FIG. 1), starts opening the left door 2, as shown in FIGS. 29A and 29B, the chamfered portion at the inner edge of the lowered portion 10*d* of the boss 10 starts mounting on the base portion 23*a*, and the left door 2 starts rising. The arm portion 16*a* of the lock member 16 deforms elastically, and the lock pin 24 starts disengaging from the engagement portion 16*b*. If the user releases the handle 4 in this state, the elastic force of the arm portion 16*a* makes the left door 2 return to the state shown in FIGS. 28A and 28B. Thus, the lock member 16 and the lock pin 24 provide an automatically closing function, which ensures secure closing of the left door 2.

As the left door 2 is opened, it rotates. However, since the guide portion 11*a* of the guide groove 11 engages with the guide pin 25, the left door 2 cannot rotate about the hinge pin 23 as long as it remains in the first locked position. Thus, the hinge pin 23 is guided by the hinge groove 9 relatively, and the guide pin 25 is guided by the guide portion 11*a* relatively. As a result, the left door 2, as it rotates, slides toward the lower left in FIG. 29A.

As the left door 2 is further opened, as shown in FIGS. 30A and 30B, the hinge pin 23 is locked at the other end of the hinge groove 9, and thus the cam mechanism is now in the second locked position. At this point, the lowered portion 10*d* of the boss 10 has completely mounted on the base portion 23*a*. Moreover, the second cam surface 10*a* of the boss 10 starts sliding along the concave surface 19*a* of the rib 19. Thus, the cam mechanism maintains the second locked position, permitting the left door 2 to rotate about the hinge pin 23.

Moreover, the clearance portion 11*b* of the guide groove 11 is formed so as to describe an arc about the hinge pin 23 as it is located in the second locked position, and serve to permit the guide pin 25 to be released relatively and simultaneously guide the rotation of the left door 2 so that the second locked position is maintained securely.

As the left door 2 is further opened, the second cam surface 10*a* of the boss 10 continues sliding along the concave surface 19*a* of the rib 19, and the lock pin 24 disengages from the lock member 16, releasing the guide pin 25 from the guide groove 11. This permits the left door 2 to be further opened.

The concave surface 19*a* of the rib 19 has only to guide the boss 10, and therefore the rib 19 may be replaced with, for example, a plurality of pins arranged in an arc concentric with the hinge pin 23. As the left door 2 is further opened, the restricting portion 16*c* of the lock member 16 makes contact with the stopper 18*e* of the lock cam member 18, restricting the range in which the left door 2 can be opened.

The left door 2 can be closed through the reversed flow of the operations described above and shown in FIGS. 28A to 30B. When the cam mechanism is back in the first locked position, the lowered portion 10*d* of the boss 10 descends from the base portion 23*a* of the hinge pin 23, so that the left door 2 is kept closed.

In this embodiment, it is possible to achieve the same effects as in the first embodiment. Moreover, although the left door 2 can be opened from the closed state with a small force, when it is closed, even under the elastic forces of the gaskets 6 and 7 and of the gaskets 41 to 43 arranged between the chassis 1 and the left door 2, the lowered portion 10*d* of the boss 10 engages with the base portion 23*a* of the hinge pin 23 and thereby maintains the first locked position securely, preventing the left and right doors 2 and 3 from being opened accidentally. Moreover, since the lowered portion 10*d* is formed on the boss 10, it can be formed easily by resin molding.

In addition, by varying the level difference between the bottom surface 10*e* of the boss 10 and the lowered portion 10*d* and the inclination of the chamfering at the inner edge of the lowered portion 10*d*, it is possible to adjust the locking force provided by the engagement between the boss 10 and the hinge pin 23 so as to obtain good operability.

Moreover, the door opening/closing mechanism of this embodiment is applicable also in a case where, instead of providing the gaskets 6 and 7, the gap between the left and right doors 2 and 3 is made narrow for dust prevention and the like. The left door 2, by sliding as it rotates, prevents interference between the end surface of the left door 2 and the right door 3.

Figure 31A:
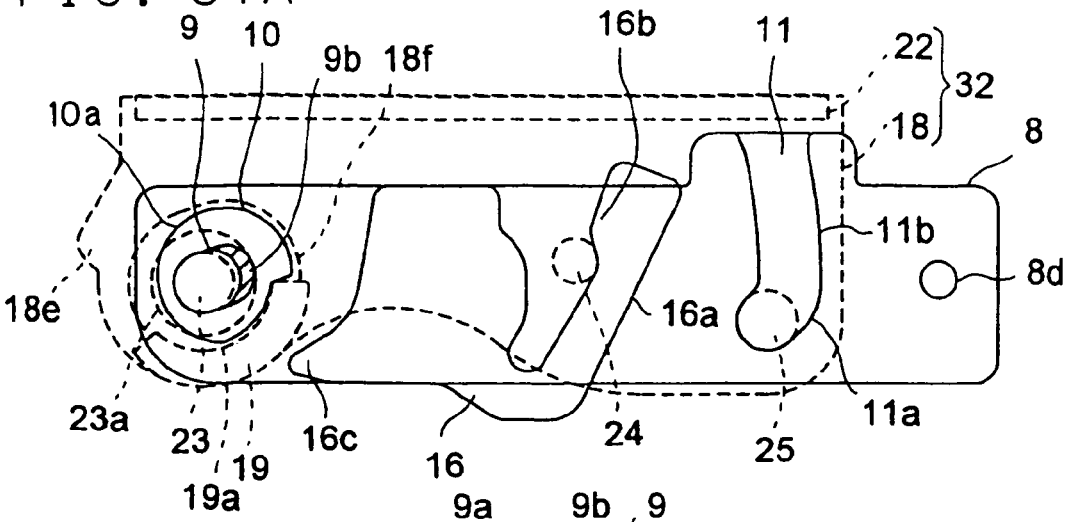
FIG. 31A is a plan view of the earn mechanism of the sixth embodiment of the invention in a first position.
Figure 31B:
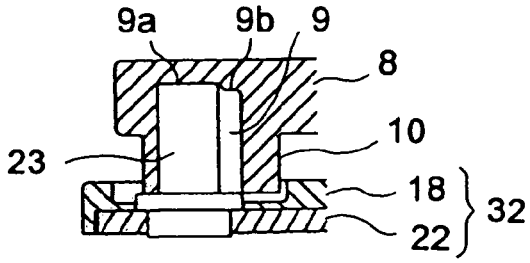
FIG. 31B is a sectional view taken through pin 23 in FIG. 31A.
Figure 32A:
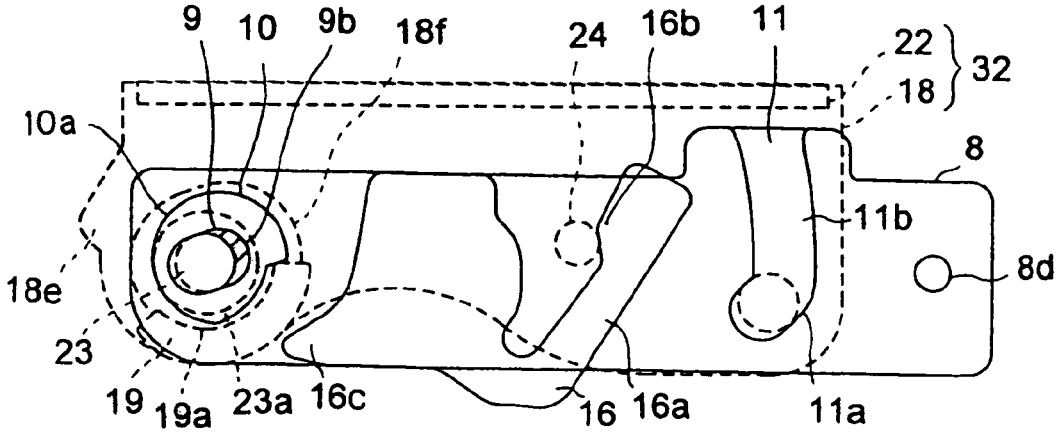
FIG. 32A is a plan view of the cam mechanism of the sixth embodiment of the invention in a second position.
Figure 32B:
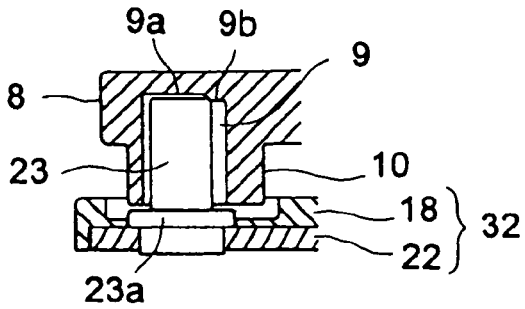
FIG. 32B is a sectional view taken through pin 23 in FIG. 32A.
Figure 33A:
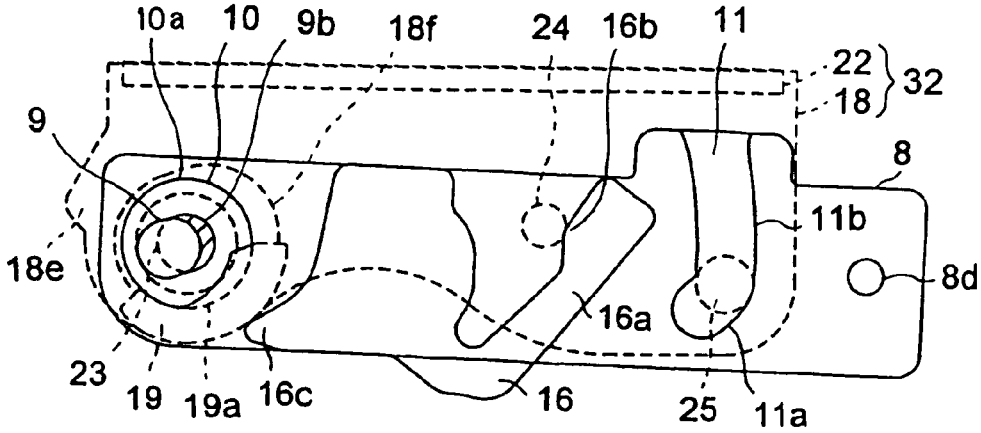
FIG. 33A is a plan view of the cam mechanism of the sixth embodiment of the invention in a third position.
Figure 33B:
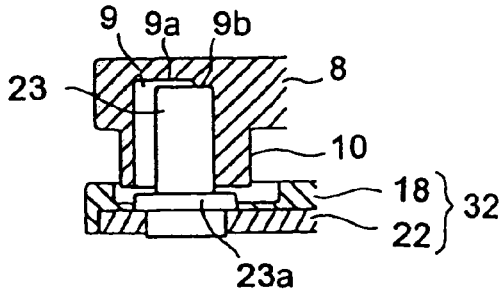
FIG. 33B is a sectional view taken through pin 23 in FIG. 33A.

Next, the door opening/closing mechanism of a sixth embodiment will be described with reference to FIGS. 31A to 33B. For convenience's sake, in these figures, such parts as are found also in the fifth embodiment shown in FIG. 28A to 30B described above are identified with the same reference numerals. FIGS. 31A, 32A, and 33A are plan views, with broken lines indicating the lock cam assembly 32 and solid lines indicating the slide cam member 8. FIGS. 31B, 32B, and 33B are sectional views along the length direction of the hinge groove 9.

This embodiment differs from the fifth embodiment in that, instead of the lowered portion 10*d* formed on the bottom surface of the boss 10, a lowered portion 9*b* is formed on the ceiling surface 9*a* of the hinge groove 9. In other respects, this embodiment is the same as the fifth embodiment.

FIGS. 31A and 31B show the cam mechanism provided at the bottom of the left door 2, as observed in the first locked position with the left door 2 closed. The hinge groove 9 has a lowered portion 9*b* (hatched in FIG. 31A) formed so as to protrude below the ceiling surface 9*a* thereof. The inner edge of the lowered portion 9*b* is formed along the hinge pin 23, and is chamfered where it makes contact with the periphery of the hinge pin 23. The ceiling surface 9*a* of the hinge groove 9 mounts on the hinge pin 23, and the lowered portion 9*b* is located below the top end of the hinge pin 23.

The chamfering permits the lowered portion 9*b* to easily mount on the hinge pin 23, and therefore the chamfering may be formed at the top end of the hinge pin 23 instead. In FIG. 31A, the inner edge of the chamfering is not shown, because it overlaps with the outline of the hinge pin 23, and it is omitted also in FIGS. 32A and 33A to avoid complicating the figures.

When the user, holding the handle 4 (see FIG. 1), starts opening the left door 2, as shown in FIGS. 32A and 32B, the chamfered portion at the inner edge of the lowered portion 9*b* starts mounting on the hinge pin 23, and the left door 2 starts rising. As the left door 2 is further opened, as shown in FIGS. 33A and 33B, the hinge pin 23 is locked at the other end of the hinge groove 9, and thus the cam mechanism is now in the second locked position.

At this point, the lowered portion 9*b* of the hinge groove 9 has completely mounted on the hinge pin 23. Moreover, the second cam surface 10*a* starts sliding along the concave surface 19*a* of the rib 19. Thus, the cam mechanism maintains the second locked position, permitting the left door 2 to rotate about the hinge pin 23.

As the left door 2 is further opened, as in the fifth embodiment, the second cam surface 10*a* of the boss 10 continues sliding along the concave surface 19*a* of the rib 19, and the lock pin 24 disengages from the lock member 16, releasing the guide pin 25 from the guide groove 11. This permits the left door 2 to be further opened. Then, the restricting portion 16*c* of the lock member 16 makes contact with the stopper 18*e* of the lock cam member 18, restricting the range in which the left door 2 can be opened.

The left door 2 can be closed through the reversed flow of the operations described above and shown in FIGS. 31A to 33B. When the cam mechanism is back in the first locked position, the lowered portion 9*b* of the hinge groove 9 descends from the hinge pin 23, so that the left door 2 is kept closed.

In this embodiment, as in the fifth embodiment, the lowered portion 9*b* can be easily formed on the ceiling surface 9*a* of the hinge groove 9 by resin molding, the door can be opened and closed with a small force, and the first locked position can be maintained securely. The same effects are achieved also when this embodiment is applied in cases where, instead of providing the gaskets 6 and 7, the gap between the right and left doors 3 and 2 is made narrow and where the opening 1*a* is opened and closed with a single door.

Instead of the lowered portion 9*b* formed in the hinge groove 9, a lowered portion may be formed on the ceiling surface of the guide groove 11. Also in this structure, just as in the structure described above, the lowered portion, by mounting on the guide pin 25, raises and opens the door and, by descending from the guide pin 25, lowers the door and maintains the first locked position.

It is to be understood that, although the first to sixth embodiments described above deal only with doors that are opened and closed in the middle, they are applicable also to door opening/closing mechanisms that open and close an opening with a single door arranged in front of the opening. Specifically, in cases where there is a wall surface, floor surface, or the like in the direction in which a door opens, the door, as it is opened, slides away from the wall or other surface and thereby prevents interference between the end of the door and the wall or other surface. This ensures easy opening and closing of the door.

Furthermore, the same effects are achieved not only with a door that is opened and closed in the right/left direction but also with a door that is opened and closed vertically or horizontally. Thus, the first to sixth embodiments can be applied to a light-weight lid such as one provided on a car's dashboard. With a door that opens downward, instead of providing a loading means such as a lock mechanism composed of a lock pin and a lock cam, the weight of the door itself may be used to load the door with a force that tends to move it toward its pivoted side.

Next, a seventh embodiment will be described with reference to FIGS. 34 to 38C. In this embodiment, such parts as are found also in the first embodiment shown in FIG. 13 to 16 are identified with the same reference numerals. The door opening/closing mechanism of this embodiment permits an opening 1*a* formed in a chassis 1 to be opened with a single door at both the left and right sides of the door.

Figure 34:
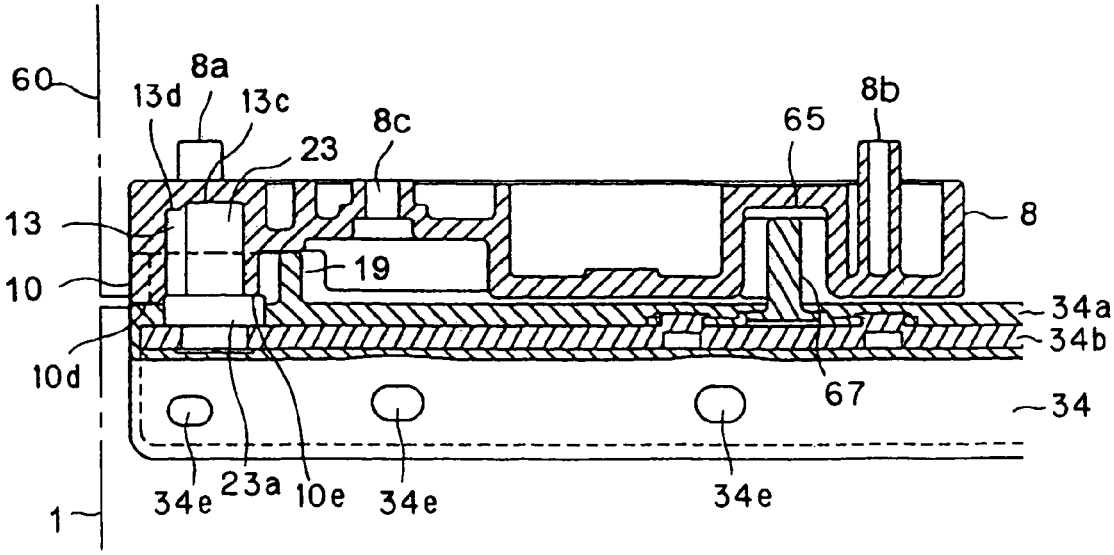
FIG. 34 is a sectional view as viewed from the front showing the cam mechanism of the door opening/closing mechanism of a seventh embodiment of the invention.

At both ends of the top and bottom sides of the door, cam mechanisms that are symmetrical in the right/left direction are provided, one pair at the top and another at the bottom. FIG. 34 is a sectional view as viewed from the front showing the cam mechanism provided at the lower left of the door. This cam mechanism is composed of a slide cam member 8 fitted to the door 60 and a hinge angle hinge angle 34 fitted to the chassis 1.

The slide cam member 8, which is a resin molding, has bosses 8*a* and 8*b* formed on the top surface, and has a screw hole 8*c* formed therethrough. The slide cam member 8 is fitted on the bottom surface of the door 60 with the bosses 8*a* and 8*b* fitted into boss holes (not shown) formed in the bottom surface of the door 60 and with a self-tapping screw (not shown) screwed through the screw hole 8*c* from below.

The hinge angle 34 is so formed as to extend from the left to the right side of the chassis 1, and is fitted to the chassis 1 with self-tapping screws (not shown) screwed through screw holes 34*e* formed in a metal angle member 34*b*. A hinge pin 23 and a lock outer cam 67, both made of metal, are swaged onto the angle member 34*b*. Moreover, a hinge cover 34*a* having a rib 19 is formed by insert molding.

Figure 35A:
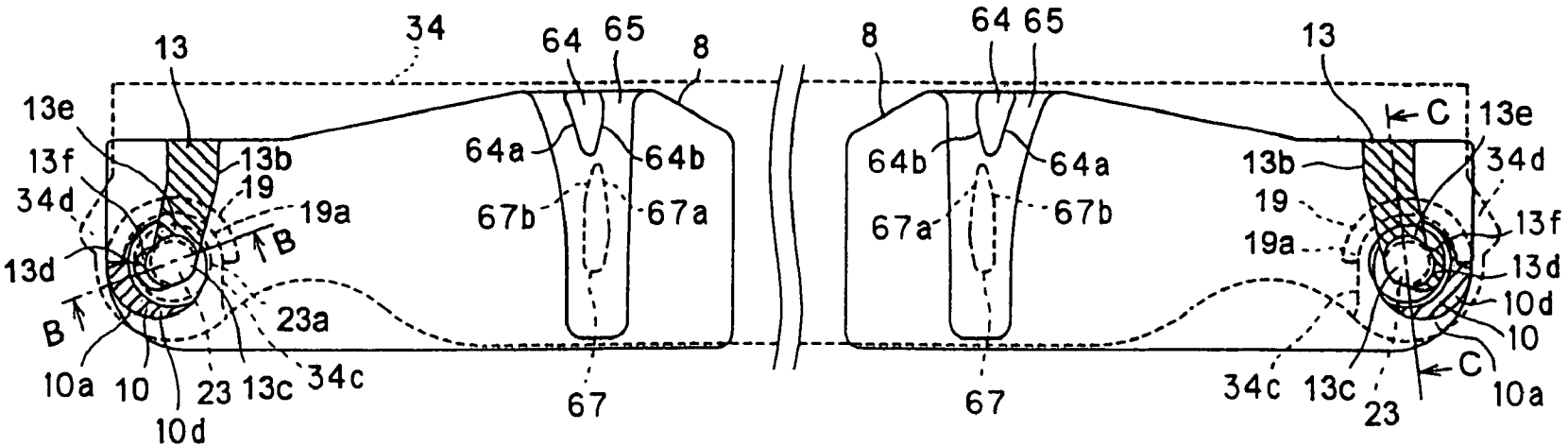
FIG. 35A is a plan view of the cam mechanism of the seventh embodiment of the invention in a first position.
Figure 35C:
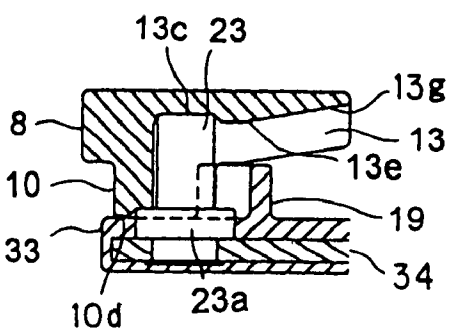
FIG. 35C is a sectional view taken along line C-C in FIG. 35A.
Figure 35B:
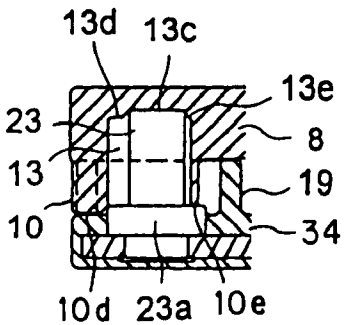
FIG. 35B is a sectional view taken along line B-B in FIG. 35A.

FIG. 35A shows a plan view of the cam mechanism. As described above, on the hinge angle 34, hinge pins 23 and lock outer cams 67 are provided in places symmetrical in the right/left direction, and slide cam members 8 are arranged in the corresponding places symmetrical in the right/left direction. The figure shows the state in which the door 60 is closed, with broken lines indicating the hinge angle 34 and solid lines indicating the slide cam member 8. FIGS. 35B and 35C are sectional views along line B-B and line C-C in FIG. 35A, respectively.

At one end of the bottom surface of the slide cam member 8, a hinge groove 13 is formed that is composed of a first and a second cam groove 13*f* and 13*b* that are connected together so as to form a shape like the letter L. The hinge pin 23 is fitted into the hinge groove 13. The distance between the second cam grooves 13*b* at the left and right sides becomes narrower and narrower rearward. Thus, even when the left and right sides of the door 60 are pulled simultaneously, the hinge pins 23 engage with the second cam grooves 13*b* and thereby inhibit the door 60 from being opened. In this way, the left and right cam mechanisms maintain the first locked position while preventing the door 60 from dropping off.

The first and second cam grooves 13*f* and 13*b* have lowered portions 13*d* and 13*e* (hatched with rightward descending lines in FIG. 35A) respectively formed so as to protrude below their ceiling surface 13*c*. The inner edge of the lowered portion 13*d* is formed along the hinge pin 23, and is chamfered where it makes contact with the periphery of the hinge pin 23. The ceiling surface 13*c* of the hinge groove 13 mounts on the hinge pin 23, and the lowered portions 13*d* and 13*e* are located below the top end of the hinge pin 23.

The chamfering permits the lowered portions 13*d* and 13*e* to easily mount on the hinge pin 23, and therefore the chamfering may be formed at the top end of the hinge pin 23 instead. In FIG. 35A, the inner edge of the chamfering is not shown, because it overlaps with the outline of the hinge pin 23.

Around the first cam groove 13*f*, a boss 10 is formed that has a second cam surface 10*a* formed thereon about the hinge pin 23 as it is located in the second locked position described later. The hinge pin 23 has a base portion 23*a* formed concentrically at the bottom. The boss 10 has a lowered portion 10*d* (hatched with rightward ascending lines in FIG. 35A) formed so as to protrude below the bottom surface 10*e* thereof.

The inner edge of the lowered portion 10*d* is formed along the base portion 23*a*, and is chamfered where it makes contact with the periphery of the base portion 23*a*. The bottom surface 10*e* of the boss 10 mounts on the base portion 23*a*. In the portion of the hinge angle 34 surrounding the base portion 23*a*, a recess 33*c* is formed to avoid interference with the lowered portion 10*d*. The chamfering permits the lowered portion 10*d* to easily mount on the base portion 23*a*, and thus the chamfering may be formed in the top surface of the base portion 23*a* instead. In FIG. 35A, the inner edge of the chamfering is not shown, because it overlaps with the outline of the base portion 23*a*.

Around the hinge pin 23, a rib 19 is formed that has a cylindrical concave surface 19*a* concentric with the hinge pin 23. In the slide cam member 8, on the side of the first and second cam grooves 13*f* and 13*b* closer to the middle of the opening, a slide outer cam 64 having slide surfaces 64*a* and 14*b* is provided that engages with the lock outer cam 67. Around the slide outer cam 64, a groove portion 65 is formed to permit the passage of the lock outer cam 67.

Figure 36A:
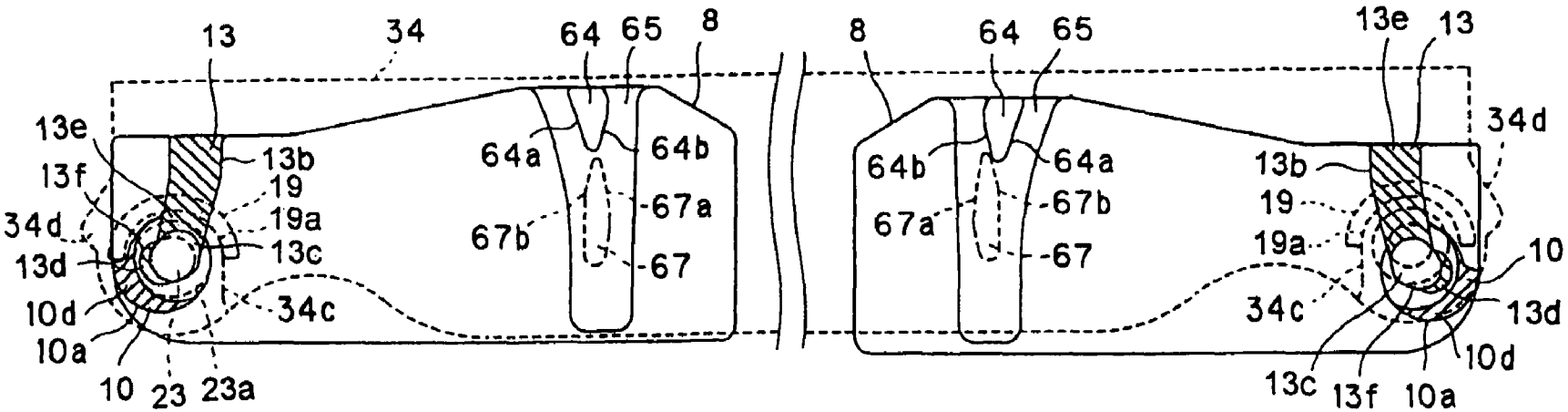
FIG. 36A is a plan view of the earn mechanism of the seventh embodiment of the invention in a second position.
Figure 36C:
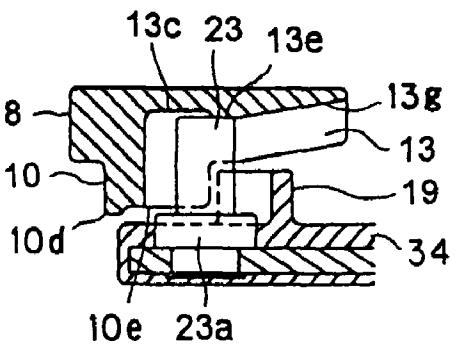
FIG. 36C is a sectional view taken through pin 23 on the opened side of the door of FIG. 36A.
Figure 36B:
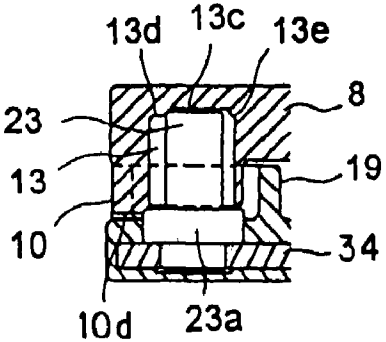
FIG. 36B is a sectional view taken through pin 23 on the pivoted side of the door of FIG. 36A.
Figure 37A:
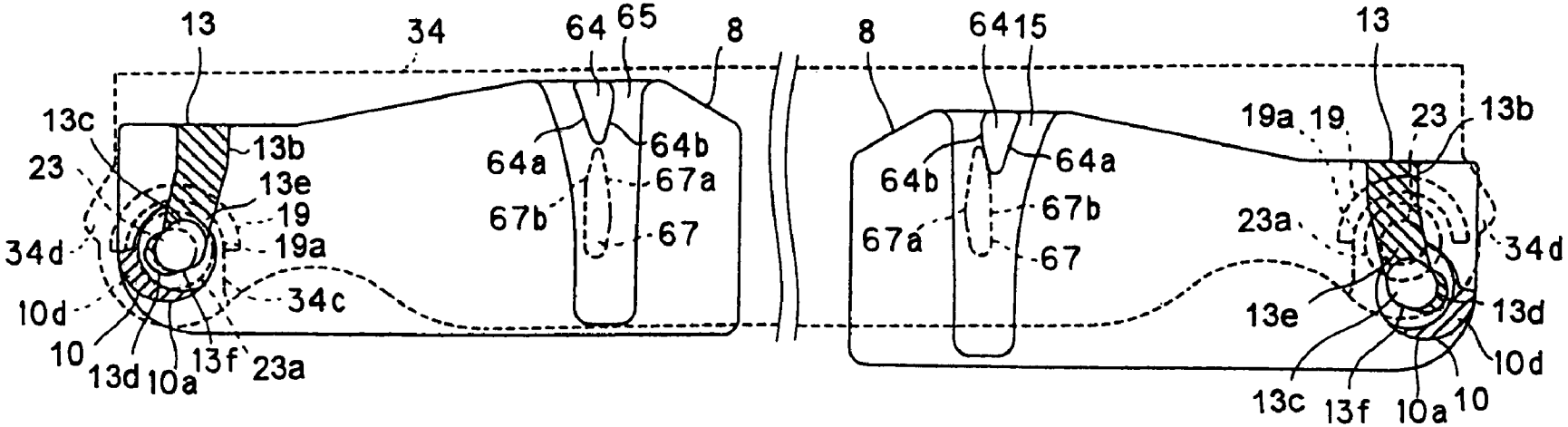
FIG. 37A is a plan view of the cam mechanism of the seventh embodiment of the invention in a third position.
Figure 37C:
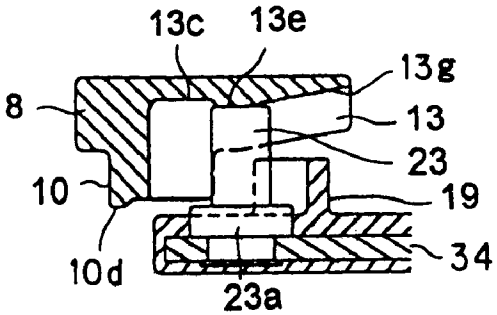
FIG. 37B is a sectional view taken through pin 23 on the pivoted side of the door of FIG. 37A.
Figure 37B:
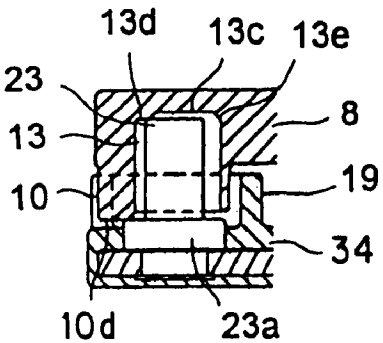
Figure 38A:
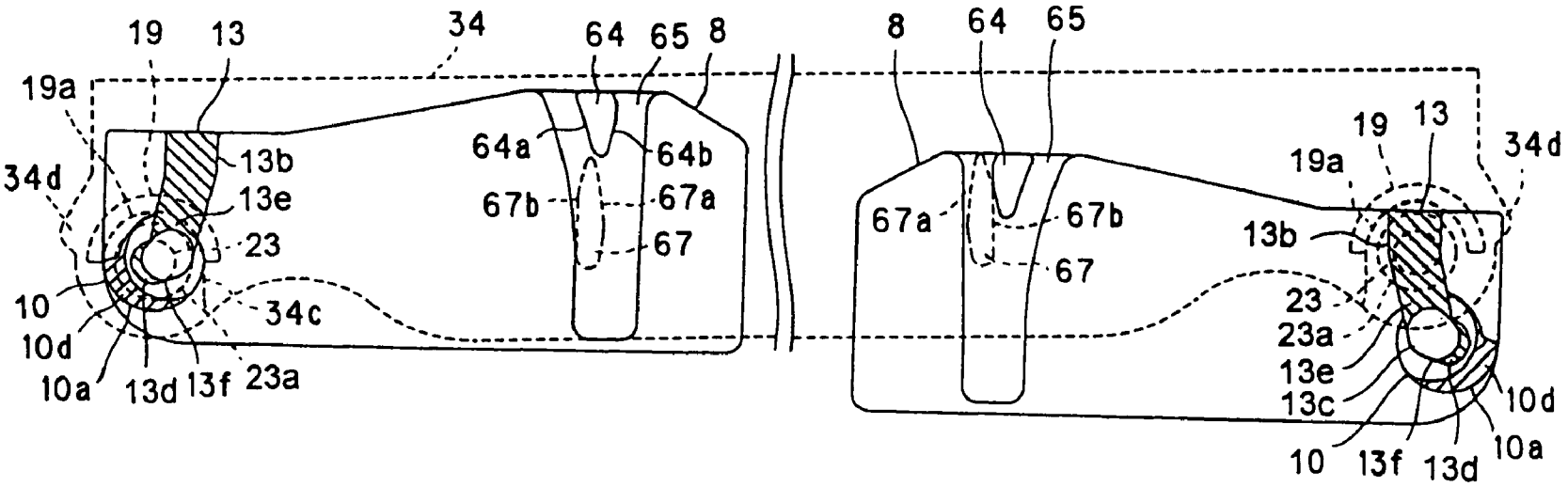
FIG. 38A is a plan view of the cam mechanism of the seventh embodiment of the invention in a fourth position.
Figure 38B:
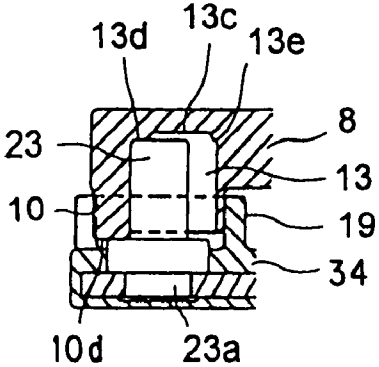
FIG. 38B is a sectional view through pin 23 on the pivoted side of the door of FIG. 38A.
Figure 38C:
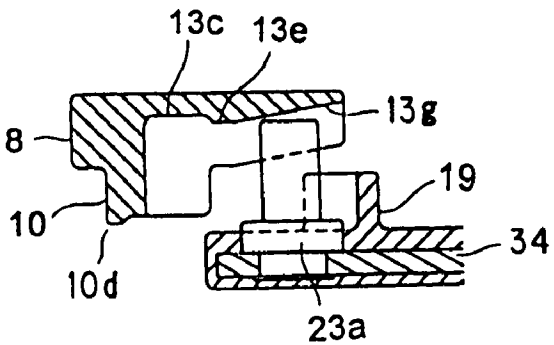

Next, the operation of the cam mechanisms will be described with reference to FIGS. 35A to 38A, taking up a case in which the door 60 is opened at the right side thereof. Since the cam mechanisms are arranged symmetrically in the right/left direction, when the door 60 is opened at the left side thereof, the cam mechanisms operate in a similar manner. FIGS. 36A, 37A, and 38A are plan views. FIGS. 36B, 37B, and 38B are sectional views along the length direction of the first cam groove 13*f* FIGS. 36C, 37C, and 38C are sectional views along the length direction of the second cam groove 13*b*. In the plan views, the inner edges of the chamfering of the lowered portions 13*d*, 13*e*, and 10*a* are omitted to avoid complicating the figures.

As described earlier, FIGS. 35A to 35C show the state in which the door 60 is closed, where the cam mechanisms are in the first locked position, preventing the door 60 from dropping off. FIGS. 36A to 36C show the state in which the door 60 starts being opened at the right side thereof. In the right cam mechanism, the hinge pin 23 is guided by the second cam groove 13*b* relatively, and the slide cam member 8 is pushed outward. Thus, the lowered portion 13*e* of the second cam groove 13*b* mounts on the hinge pin 23.

In the left cam mechanism, the hinge pin 23 is guided by the first cam groove 13*f* relatively, and the slide cam member 8 is pushed inward. Thus, the lowered portion 13*d* of the first cam groove 13*f* starts mounting on the hinge pin 23. Moreover, the lowered portion 10*d* of the boss 10 starts mounting on the base portion 23*a* of the hinge pin 23. As a result, the door 60 rises, and simultaneously slides rightward while rotating. Moreover, at the right side, the slide surface 67*b* of the lock outer cam 67 and the slide surface 64*b* of the slide outer cam 64 start sliding along each other.

As the door 60 is further opened at the right side, as shown in FIGS. 37A to 37C, in the right cam mechanism, the slide outer cam 64 is guided by the lock outer cam 67, so that the hinge pin 23 continues being guided by the second cam groove 13*b* relatively. By being guided in two places apart from each other, the left cam mechanism is securely shifted to the second locked position described later.

Moreover, in the left cam mechanism, the hinge pin 23 continues being guided by the first cam groove 13*f*, so that the lowered portions 13*d* and 10*a* of the first cam groove 13*f* and the boss 10 completely mount on the hinge pin 23 and the base portion 23*a*, respectively. To permit the lowered portions 10*d* and 13*d* of the left cam mechanism and the lowered portion 13*e* of the right cam mechanism to mount on the hinge pin 23 and the base portion 23*a* simultaneously, the first cam groove 13*f* side edge of the lowered portion 13*e* may be chamfered with a gentle inclination. This prevents the door 60 from inclining when it is opened or closed, and thus helps stabilize the opening/closing movement thereof.

As the door 60 is further opened at the right side, as shown in FIGS. 38A to 38C, in the left cam mechanism, the hinge pin 23 is locked at the end of the first cam groove 13*f*, and thus the left cam mechanism is now in the second locked position. Moreover, the second cam surface 10*a* of the boss 10 starts sliding on the concave surface 19*a* of the rib 19. Thus, the cam mechanism maintains the second locked position, permitting the left door 2 to rotate about the hinge pin 23 as it is located in the second locked position.

Then, as the door 60 rotates, in the left cam mechanism, the slide surface 64*a* of the slide outer cam 64 and the slide surface 67*a* of the lock outer cam 67 slide along each other so that the second locked position is maintained securely. Here, it is preferable, in the right cam mechanism, to make the top surface of the lock outer cam 67 and the bottom surface of the slide cam member 8, or the bottom surface of the slide outer cam 64 and the top surface of the hinge angle 34, slide along each other.

Specifically, as shown in FIG. 38C, to avoid the collision between the second cam groove 13*b* and the hinge pin 23 when they start engaging while the door 60 is being closed, an inclined surface 13*g* that is inclined toward the open end is formed on the ceiling surface of the second cam groove 13*b*.

This produces a gap in the height direction between the hinge pin 23 and the hinge groove 13 at the right side. Thus, making the top surface of the lock outer cam 67 and the bottom surface of the slide cam member 8, or the bottom surface of the slide outer cam 64 and the top surface of the hinge angle 34, slide along each other permits the door 60 to be opened and closed stably in the height direction.

Thereafter, at the right side, the second cam groove 13*b* disengages from the hinge pin 23 and the lock outer cam 67 disengages from the slide outer cam 64, and, at the left side, the lock outer cam 67 disengages from the slide outer cam 64. Thus, the opening is now open. As the door is further opened, a contact portion (not shown) formed integrally with the slide cam member 8 makes contact with a stopper 33*d*, restricting the range in which the door 60 can rotate.

The door 60 can be closed through the reversed flow of the operations described above and shown in FIGS. 35A to 38C. When the cam mechanisms are back in the first locked position, in the left cam mechanism, the lowered portion 10*d* of the boss 10 descends from the base portion 23*a* of the hinge pin 23, and the lowered portion 13*d* of the first cam groove 13*f* descends from the hinge pin 23. Moreover, in the right cam mechanism, the lowered portion 13*e* of the second cam groove 13*b* descends from the hinge pin 23. Thus, the door 60 is closed.

In this embodiment, when the door 60 starts being opened, the cam mechanisms guide the door 60 so that the door 60 slides to the second locked position and is held there. This permits the door 60 to be opened at both the right and left sides thereof without dropping off. Moreover, the weight of the door 60 is borne by the hinge pin 23 and the base portion 23*a*. This helps reduce the contact area and thus the sliding friction, and thereby permits the door 60 to be opened with a small force.

Moreover, when the door 60 is closed, the lowered portion 10*d* of the boss 10 engages with the base portion 23*a* of the hinge pin 23, and the lowered portions 13*d* and 13*e* of the first and second cam grooves 13*f* and 13*b* engage with the hinge pin 23. Thus, the first locked position is maintained securely. Therefore, even when gaskets or the like are arranged between the chassis 1 and the door 60, the door 60 is prevented from opening under the elastic force of the gaskets or the like.

In any combination of a hinge pin and a hinge groove or of a rib and a boss, one may be provided on the part of either of the main unit and the door, with its partner provided on the part of the other.

In the fifth to seventh embodiments, with a light-weight door, the engagement force between a lowered portion and a hinge pin, base portion, or the like in the first locked position may be too small to keep the door closed against the elastic force of gaskets or the like. In such a case, a spring or the like that loads the door with a force that presses it, for example, downward along its axis may be provided. This helps maintain the engagement of the lowered portion and keep the door closed securely. Since the force exerted by the spring or the like acts vertically to the direction in which the door is opened, additionally providing it only slightly increases the force required to open the door, and thus does not spoil operability.

Likewise, loading a door with a force that presses it along its axis offers the same effects not only with a door that is opened and closed in the right/left direction, but also with a door that opens and closes in the up/down direction an opening formed in the front face of a main unit or a door that opens and closes in the horizontal direction the top face of a main unit. It can be applied to a light-weigh lid such as one provided on a car's dashboard, and even to a door covering an inclined surface.

INDUSTRIAL APPLICABILITY

According to the present invention, in a cam mechanism, the slide-contact between a rib and a first cam surface permits the pivoted position of a rotary member to slide, and the slide-contact between the rib and a second cam surface restricts the pivoted position of the rotary member. Thus, with a simple structure, it is possible to shift the rotary member between a pivoted position in which it is restricted and a pivoted position in which it is not necessarily restricted.

According to the present invention, in a cam mechanism, the rotary member is loaded with a force that tends to move it in the opposite direction to the direction in which it can slide. This makes it easy to restrict the position of the rotary member before it starts sliding.

According to the present invention, in a door opening/closing mechanism, when a door starts being opened, the pivoted position of the door slides. This permits, when there is a wall surface, floor surface, or the like in the direction in which the door opens, the door to move away from the wall surface or the like, and thereby prevents interference between the open end of the door and the wall surface or the like. Moreover, the weight of the door is borne by its pivot shaft. This reduces the contact area and hence the sliding friction, and thus helps reduce the force needed to open and close the door.

According to the present invention, in a door opening/closing mechanism, in a case where it is applied to a hinged double doors, when the doors start being opened, they slide in such a way that the open end of one door moves away from the other door. This alleviates the rubbing together between the open ends of the two doors when they are opened and closed, and thus enhances operability. Moreover, there is no need for a slide member for permitting the pivoted position of a door to slide or a spring for permitting it to slide back to its original position as required in conventional structure, and thus it is possible to reduce the number of parts needed.

According to the present invention, in a door opening/closing mechanism, the slide-contact between a rib and a second cam surface restricts a hinge pin in a predetermined position in a hinge groove, and thereby permits the door to be pivotably supported. This makes it possible to realize an inexpensive hinge mechanism of a shiftable pivoted position type employing a simple and compact cam mechanism.

According to the present invention, in a door opening/closing mechanism, as the door starts being opened, it is guided also by a guide structure. This helps realize a cam mechanism that ensures smooth shifting.

According to the present invention, in a door opening/closing mechanism, the hinge mechanism is formed integrally with the guide structure, making it possible to realize a cam mechanism that offers satisfactory dimensional accuracy and ensures smooth shifting. Moreover, the guide structure is composed of a pin and a groove, and therefore the door can be guided smoothly in two directions by the use of opposite surfaces of the groove. Thus, it is not always necessary to provide a loading means for restricting the pivoted position of the door when it is closed.

According to the present invention, in a door opening/closing mechanism, as the door rotates, the hinge pin travels a shorter distance than the guide pin does. This makes it possible to realize a cam mechanism that ensures smooth shifting.

According to the present invention, in a door opening/closing mechanism, even when a predetermined pivoted position or other prescribed position (for example, with hinged double doors, the position in which the open end of one door is kept in close contact with the open end of the other door with a gasket sandwiched in between) is indefinite because of dimensional errors or the like, it does not occur that the guide pin makes contact with the end of the guide groove and thereby restricts the position of the door before that position is reached.

According to the present invention, in a door opening/closing mechanism, a guide portion and a clearance portion cross each other at an angle in the range from 120° to 170°. This permits a larger proportion of the force applied to open and close the door to act in the guide direction of the guide portion, and in addition reduces the sliding friction between the guide pin and the wall surfaces of the guide groove. This ensures smooth opening and closing of the door.

According to the present invention, in a door opening/closing mechanism, the guide pin is arranged farther away from the opening than the hinge pin is. This helps make the guide groove sufficiently long, and thus permits more stable opening and closing of the door.

According to the present invention, in a door opening/closing mechanism, when the door is closed, a lock member engages with a lock pin and thereby loads the lock pin with a force that press it toward the pivoted side, so that, under reaction, the lock member is loaded with a force that presses it toward the non-pivoted side. Thus, the door is loaded with a force that presses it toward the non-pivoted side, and its position is thereby restricted. When the door is opened, the lock member elastically deforms and disengages from the lock pin, and the door slides. In this way, the door shifts between two pivoted positions each restricted.

According to the present invention, in a door opening/closing mechanism, for smooth shifting, it is preferable that the hinge pin and the guide pin be arranged apart from each other. Moreover, arranging the lock pin between the hinge pin and the guide pin contributes to effective use of the available space and thus helps make the lock mechanism compact.

According to the present invention, in a door opening/closing mechanism, the lock member is shared as a loading means for loading the door with a force that presses it toward the non-pivoted side and a loading means for loading the door with a force that presses it in the direction in which it opens. This helps reduce the number of parts needed and thereby reduce costs.

According to the present invention, in a door opening/closing mechanism, the electric components provided in the door are connected by electric leads laid through a through hole, and the required length of the electric leads does not vary as the door is opened and closed. This helps prevent sagging or straining of the electric leads.

According to the present invention, in a door opening/closing mechanism, it is possible to prevent the electric leads from being damaged in the through hole as the door slides.

According to the present invention, in a door opening/closing mechanism, depending on how the door is opened, when it slides from the non-pivoted side to the pivoted side, it simultaneously slides away from the opening (i.e. forward). In cases where gaskets or the like are provided between the door and the opening to achieve hermetic contact, this prevents damage to the gaskets resulting from repeated compression.

According to the present invention, in a door opening/closing mechanism, a cam mechanism that is in a first locked position when the door is closed and that, as the door is opened, slides the door from the open side to the pivoted side to shift to a second locked position, where the cam mechanism pivotably supports the door, has different portions thereof arranged separately at the pivoted and open sides of the door. This makes it possible to arrange at the open side of the door a positioning portion for positioning in the first locked position and a guide portion for guiding from the first locked position to the second locked position.

By arranging the positioning portion at the open side of the door, even when there are errors in the fitting and dimensions of the cam mechanism, it is possible to reduce the degree to which the door is open at its open side because of those errors as compared with a case in which the positioning portion is provided at the pivoted side. This helps keep the door hermetically closed securely.

Moreover, by arranging the guide portion at the open side of the door and arranging a hinge portion, for pivotably supporting the door in the second locked position, at the pivoted side, it is possible to reduce the angle between the guide direction of the guide portion and the direction in which the force applied to open the door acts as compared with a case where the guide portion is arranged at the pivoted side. This helps reduce the sliding friction in the guide portion and thereby reduce the force needed to open and close the door, and thus helps enhance the operability of the door opening/closing mechanism.

According to the present invention, in a door opening/closing mechanism, it is easy to realize a cam mechanism that shifts from a first locked position to a second locked position by guiding a hinge pin with a hinge groove and guiding a guide pin with a guide groove and that, as the door is opened, makes a rib and a boss slide on each other in the second locked position and thereby slides from the first locked position to the second locked position, where the cam mechanism pivotably supports the door.

According to the present invention, in a door opening/closing mechanism, the end of the guide groove is extended to form an arc-shaped portion along a circumference about the hinge pin as it is located in the first locked position. This makes it possible to rotate the door already in the first locked position further in the direction in which it closes even when there are errors in the fitting and dimensions of the cam mechanism, and thus to keep the door hermitically closed more securely.

According to the present invention, in a door opening/closing mechanism, compared with the distance traveled by the guide pin or hinge pin when it moves relatively from the first locked position to the second locked position, the guide groove or hinge groove measures more in the direction of that relative movement. This permits the door to move toward another door and simultaneously in the front/back direction so that the hinge pin reaches the predetermined first locked position even when there are errors in the fitting and dimensions of the cam mechanism. This helps keep the door and the main unit in hermetic contact with each other securely, and also helps maintain a predetermined distance from the door to the other door.

According to the present invention, in a door opening/closing mechanism, the cam mechanism not only makes the door slide but also, by means of a lowered portion, makes the door, when reaching the first locked position, move along its rotation axis. This helps keep the door closed securely even when gaskets or the like are arranged between the main unit and the door.

According to the present invention, in a door opening/closing mechanism, the door is supported at the tip of the guide pin, and the lowered portion is formed in the guide groove on which the tip of the guide pin slides. In this way, the lowered portion can be formed easily to permit the door to move along its rotation axis in the first locked position.

According to the present invention, in a door opening/closing mechanism, the door is supported at the tip of the hinge pin, and the lowered portion is formed in the hinge groove on which the tip of the hinge pin slides or in the first and second cam grooves. In this way, the lowered portion can be formed easily to permit the door to move along its rotation axis in the first locked position.

According to the present invention, in a door opening/closing mechanism, the door is supported at the bottom surface of the boss, and the lowered portion is formed on the bottom surface of the boss. In this way, the lowered portion can be formed easily to permit the door to move along its rotation axis in the first locked position.

The invention claimed is:

1. A door opening and closing mechanism for pivotably supporting a first door in front of an opening formed in a main unit of an appliance in such a way that the first door can be opened and closed, wherein a first end of the first door and a first end of the main unit are located at a side of the main unit where a hinge pin, about which the first door pivots, is arranged, and wherein said first end of the first door and said first end of the main unit constitute a first end portion and wherein a second end of the first door and a second end of the main unit are located at a side of the main unit opposite said side of the main unit where the hinge pin is arranged and constitute a second end portion, the mechanism comprising:

said hinge pin provided on one of the main unit and the first door, the hinge pin having the first door pivoted thereon;

a cam member provided on another one of the main unit and the first door not having the hinge pin, the cam member having first and second cam surfaces formed thereon, the second cam surface being a convex cylindrical surface, the first cam surface extending from the second cam surface;

a camming structure provided on the one of the main unit and the first door having the hinge pin, the camming structure making a constant engaging contact with the cam member and having an inner curved surface concentric with the hinge pin, the camming structure being arranged along the cylindrical surface so as to slide on the cylindrical surface when in contact with the second cam surface of the cam member, the hinge pin being arranged on a side of the camming structure facing a center of the cylindrical surface; and a hinge groove comprising an elongate hole closed at both ends, the hinge groove being formed in the cam member, the hinge groove having the hinge pin loosely fitted thereinto, and the camming structure being located outside the hinge groove, wherein, as the camming structure moves along the first cam surface toward the second cam surface, the hinge pin moves relative to the hinge groove to permit the first door to slide toward the first end of the main unit from the second end of the main unit so that the hinge pin and the hinge groove engage with each other and at the same time the camming structure and the second cam surface slide-engage with each other and thereby restrict movement of the hinge pin relative to the hinge groove.

2. The door opening and closing mechanism as claimed in claim 1, wherein a first member of a guide structure for guiding the first door is provided on one of the main unit of the appliance and the first door and a second member of said guide structure is provided on the other of the main unit of the appliance and the first door, and slide-engagement between said first member and said second member as the first door is initially opened from its closed position permits a pivot axis of the first door to be slid.

3. The door opening and closing mechanism as claimed in claim 2, wherein said first member of the guide structure is a guide pin and is formed integrally with the hinge pin and the camming structure, and said second member of the guide structure is a guide groove and is formed integrally with the cam member having the hinge groove formed therein.

4. The door opening and closing mechanism as claimed in claim 3, wherein the guide pin is arranged between the hinge pin and said second end of the main unit.

5. The door opening and closing mechanism as claimed in claim 3, wherein with the first door closed, a gap exists between the guide pin and the guide groove.

6. The door opening and closing mechanism as claimed in claim 3, wherein the guide groove has a guide portion for guiding the guide pin as the first door is rotated and shifted and a clearance portion for guiding and releasing the guide pin as the first door rotates after the first door is shifted, and a centerline of the guide portion and a centerline of the clearance portion cross each other at an angle in a range from 120° to 170°.

7. The door opening and closing mechanism as claimed in claim 3, wherein the guide pin is ranged farther away than the hinge pin from the opening.

8. The door opening and closing mechanism as claimed in claim 3, further comprising:

a lock mechanism having a lock pin provided on one of the main unit of the appliance and the first door; and a lock member provided on the other of the main unit of the appliance and the first door, the lock member engaging with the lock pin when the first door is closed so as to load the first door with a force that urges the first door toward the main unit to thereby keep the first door closed, the lock member elastically deforming so as to disengage from the lock pin when the first door starts being opened, wherein the lock pin is arranged between the hinge pin and the guide pin.

9. The door opening and closing mechanism as claimed in claim 1, further comprising:

a lock mechanism having a lock pin provided on one of the main unit of the appliance and the first door; and a lock member provided on the other of the main unit of the appliance and the first door, the lock member engaging with the lock pin when said first door is closed so as to load the first door with a force that urges the first door toward the main unit to thereby keep the first door closed, the lock member elastically deforming so as to disengage from the lock pin when the first door starts being opened.

10. The door opening and closing mechanism as claimed in claim 9, wherein the lock member includes a loading means for loading the first door with the force that tends to move the first door toward the main unit when said first door is closed.

11. A door opening and closing mechanism as claimed in claim 1, including a second door having a second end adjacent to the first door second end when the first and second doors are closed relative to the opening and said second door having a first end spaced from the second door second end, a second mechanism being arranged at the first end of the second door, and the first and second doors opening in opposite directions.

12. The door opening and closing mechanism as claimed in claim 1, wherein the elongate hole extends only in a direction oblique to opposing surfaces of the main unit and the first door.

13. The door opening and closing mechanism as claimed in claim 1, wherein the mechanism permits the first door to be slid away from the opening.

14. The door opening and closing mechanism as claimed in claim 1, wherein the hinge pin has an elongate-hole-shaped through hole formed therethrough in an axial direction thereof and said elongate hole of said hinge groove comprises a through hole.

15. A cam mechanism for guiding a rotary member that opens and closes an opening formed in a base member, wherein a first end of the rotary member and a first end of the base member are located at a side of the base member where a pivot shaft, about which the rotary member pivots, is arranged, and wherein said first end of the rotary member and said first end of the base member constitute a first end portion and wherein a second end of the rotary member and a second end of the base member are located at a side of the base member opposite said side of the base member where the pivot shaft is arranged and constitute a second end portion, the cam mechanism comprising:

the pivot shaft provided on one of the base member and the rotary member, the pivot shaft having the rotary member pivoted thereon;

a cam member provided on another one of the base member and the rotary member not having the pivot shaft, the cam member having first and second cam surfaces formed thereon, the second cam surface being a convex cylindrical surface, the first cam surface extending from the second cam surface;

a camming structure provided on the one of the base member and the rotary member having the pivot shaft, the camming structure making a constant engaging contact with the cam member and having an inner curved surface concentric with the pivot shaft, the camming structure being arranged along the cylindrical surface so as to slide on the cylindrical surface when in contact with said second cam surface of the cam member, the pivot shaft being arranged on a side of the camming structure facing a center of the cylindrical surface; and a shaft socket comprising an elongate hole closed at both ends, the shaft socket being formed in the cam member, the shaft socket having the pivot shaft loosely fitted thereinto, and the camming structure being located outside the shaft socket, wherein, as the camming structure moves along the first cam surface toward the second cam surface, the pivot shaft moves relative to the shaft socket to permit the rotary member to slide toward the first end of the base member from the second end of the base member so that the pivot shaft and the shaft socket engage with each other and at the same time the camming structure and the second cam surface slide-engage with each other and thereby restrict movement of the pivot shaft relative to the shaft socket.

16. The cam mechanism as claimed in claim 15, further comprising:

loading means for loading the camming structure and the first cam surface with a force that tends to move the camming structure and the first cam surface in a direction in which the camming structure and the first cam surface make contact with each other.

17. The cam mechanism as claimed in claim 15, wherein said elongate hole extends only in a direction oblique to opposing surfaces of the base member and the rotary member.

* * * * *